US007746190B2

(12) United States Patent
Vanin et al.

(10) Patent No.: US 7,746,190 B2
(45) Date of Patent: Jun. 29, 2010

(54) POLARIZATION-PRESERVING WAVEGUIDE FILTER AND TRANSFORMER

(75) Inventors: Felice M. Vanin, Rome (IT); Edward J. Wollack, Clarksville, MD (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 11/748,969

(22) Filed: May 15, 2007

(65) Prior Publication Data

US 2007/0262835 A1 Nov. 15, 2007

Related U.S. Application Data

(60) Provisional application No. 60/811,148, filed on May 15, 2006.

(51) Int. Cl.
*H01P 3/04* (2006.01)
*H01P 1/17* (2006.01)
*H01P 1/161* (2006.01)

(52) U.S. Cl. ..... 333/21 A; 333/125

(58) Field of Classification Search ..... 333/208, 333/209, 212, 110, 202, 21 A, 157, 135, 125, 333/137; 385/37; 342/365
See application file for complete search history.

(56) References Cited

U.S. PATENT DOCUMENTS 3,852,748 A * 12/1974 Stark ..... 342/365
4,568,894 A * 2/1986 Gannon et al. ..... 333/202
4,881,051 A * 11/1989 Tang et al. ..... 333/208
5,382,931 A * 1/1995 Piloto et al. ..... 333/208
6,097,264 A * 8/2000 Vezmar ..... 333/21 A
6,282,341 B1 * 8/2001 Digonnet et al. ..... 385/37
6,522,215 B2 * 2/2003 Enokuma ..... 333/21 A
6,577,207 B2 * 6/2003 Volman ..... 333/125
6,879,226 B2 4/2005 Vigneron et al.
7,321,277 B2 * 1/2008 Broad et al. ..... 333/110

OTHER PUBLICATIONS

F.M. Vanin et al., "Polarization-Preserving Quadruple-Ridge Waveguide Filter and Four-fold Symmetric Transformer", IEEE MTT-S, International Microwave Symposium Digest, 2006, pp. 127-130, San Francisco, CA USA.

S. Amari et al., "Design of polarization-preserving circular waveguide filters with attenuation poles", Microwave and Optical Technology Letters, Dec. 2001, pp. 334-336, vol. 31, No. 5, San Francisco, CA USA.

(Continued)

*Primary Examiner*—Vibol Tan
*Assistant Examiner*—Crystal L Hammond

(57) ABSTRACT

A microwave waveguide filter includes an input waveguide section, an output waveguide section, a plurality of resonator sections disposed between the input and output waveguide sections, and a plurality of coupling sections disposed on either side of each of the resonator sections. The input waveguide section, the resonator sections, and the output waveguide section have at least four fold symmetric quadruple ridge cross-sections and the coupling sections have at least four fold symmetric cross-sections.

29 Claims, 17 Drawing Sheets

OTHER PUBLICATIONS

A.M.K Saad, "Novel lowpass harmonic filter for satellite application", IEEE MTT-S International Microwave Symposium Digest, May 1984, pp. 292-294, vol. 84, San Francisco, CA USA.

Z.M. Liu et al., "An Extremely Wideband Ridge Waveguide Filter", IEEE MTT-S International Microwave Symposium Digest, Jun. 2004, pp. 615-618, vol. 2, Fort Worth, TX USA.

Y. Rong et al., "Characteristic of Generalized Rectangular and Circular Ridge Waveguides", IEEE Transaction Microwave Theory Techniques, Feb. 2000, pp. 258-265, vol. 48, No. 2.

F.M. Vanin et al., "Dimensional synthesis for wide-band waveguide filters and diplexers", IEEE Transaction Microwave Theory and Techniques, Nov. 2004, pp. 2488-2495, vol. 52, No. 11.

Y.Rong et al., "LTCC Wide-Band Ridge-Waveguide Bandpass Filters", IEEE Transaction on Microwave Theory and Techniques, Sep. 1999, pp. 1836-1840, vol. 47, No. 9.

E. Wollack, "A Full Waveguide Band Orthomode Junction," NRAO, EDIR Memo Series, #303, 1996.

E.J. Wollack et al., "The Boifot Orthomode Junction," NRAO, ALMA Memo Series, #425, May 2002.

* cited by examiner

POLARIZATION-PRESERVING WAVEGUIDE FILTER AND TRANSFORMER

CROSS-REFERENCE TO RELATED APPLICATIONS

This application claims the benefit of priority from U.S. provisional patent application Ser. No. 60/811,148 filed May 15, 2006, which is hereby incorporated by reference.

ORIGIN OF INVENTION

The invention described herein was made by employees of the United States Government, and may be manufactured and used by or for the Government for governmental purposes without the payment of any royalties thereon or therefor.

BACKGROUND OF THE INVENTION

The present invention relates in general to microwave filters and in particular to a band pass microwave waveguide filter that preserves the polarization of the input signal.

Microwave and millimeter wave continuum imaging systems are used in contraband detection, material characterization, remote sensing and astronomical applications. During the measurements, the polarization of the input signal must be preserved in order to extract the desired signatures without measurement bias. Although a conventional filter can be designed to meet the out-of-band requirements, the conventional filter does not preserve the polarization of each mode. On the other hand, conventional filters that preserve dual polarization exhibit poor out-of-band response.

In traditional system configurations used to achieve this functionality, an orthomode transducer (OMT) separates the polarization into vertical and horizontal polarization states and allows for the use of rectangular waveguide structures cascaded with waffle filters to define the frequency band of the two polarization states. However, this configuration is complex, requires two high performance filters and an OMT. In addition, the structure does not have much control in the shift of higher order modes and is not able to suppress the repetition of the fundamental mode by increasing the filter order. Therefore, there is a need for a microwave filter that preserves polarization of the input signal and has excellent out-of-band rejection achieved by suppressing spurious modes.

SUMMARY OF THE INVENTION

It is an object of some embodiments of the invention to provide a microwave filter that preserves polarization of the input signal.

It is another object of some embodiments of the invention to provide a microwave filter that is appropriate for integration into existing OMT designs or dual polarization detection mounts, depending on the application needs.

It is another object of some embodiments of the invention to provide a microwave filter that has excellent out-of-band rejection.

It is a further object of some embodiments of the invention to provide a microwave filter that suppresses fundamental mode repetition.

One aspect of the invention may be a waveguide filter comprising an input waveguide section; an output waveguide section; a plurality of resonator sections disposed between the input and output waveguide sections; and a plurality of coupling sections disposed on either side of each of the resonator sections; wherein the input waveguide section, the resonator sections, and the output waveguide section comprise at least four-fold symmetric quadruple ridge cross-sections and the coupling sections comprise at least four-fold symmetric cross-sections.

Another aspect of the invention may be a waveguide filter comprising an input waveguide section and an output waveguide section; a first at least four fold symmetric quadruple-ridge section adjacent the input waveguide section; a plurality of resonator sections disposed between the first quadruple-ridge section and the output waveguide section, a first resonator section being disposed adjacent the first quadruple-ridge section; and a plurality of coupling sections alternately disposed between the resonator sections; wherein the input waveguide section, the resonator sections, and the output waveguide section have second, at least four fold symmetric quadruple ridge cross-sections; the coupling sections have at least four fold symmetric cross-sections and the first quadruple-ridge section adjacent the input waveguide section includes ridges having lengths that are less than lengths of ridges of the second quadruple ridge cross-sections.

A further aspect of the invention may be a transformer comprising a housing with an at least four fold symmetric interior perimeter; and four ridges disposed at ninety degree intervals inside the interior perimeter, each ridge comprising a series of steps.

Further aspects of the invention may be combinations of the inventive waveguide filters and the inventive transformer.

Yet another aspect of the invention may be a waveguide structure comprising a pair of quadruple ridge waveguide sections having at least four fold symmetry; and a four fold symmetric evanescent section disposed between the pair of quadruple ridge resonator sections.

Further objects, features and advantages of the invention will become apparent from the following detailed description taken in conjunction with the following drawing.

DETAILED DESCRIPTION OF THE PREFERRED EMBODIMENTS

Figure 1:
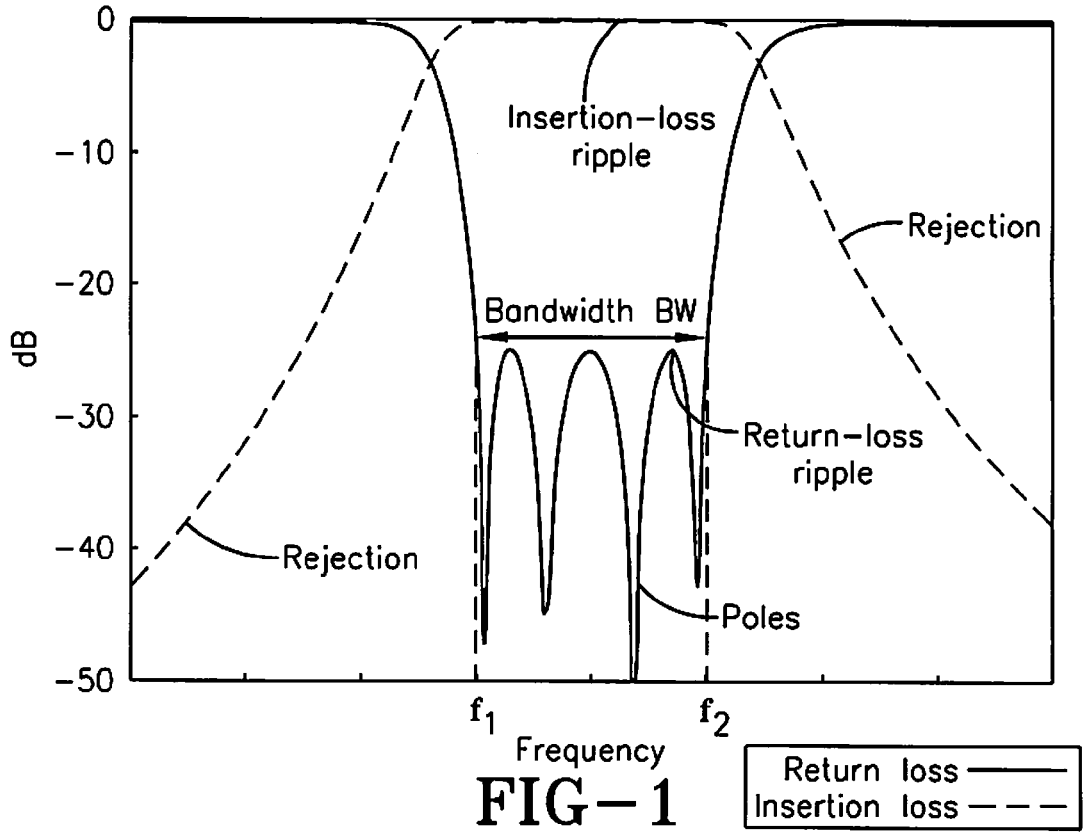
FIG. 1 shows a typical response of a filter, according to an embodiment.

For microwave applications, it may be desirable to characterize filter response with scattering parameters S expressed in dB value. FIG. 1 shows a typical response of a band pass filter and some of the parameters used, which can be defined as:

Insertion loss IL: The ratio, expressed in dB, of incident power $P_{in}$ to transmitted power $P_t$:

$$IL = 10\mathrm{Log}_{10}\left(\frac{P_{in}}{P_t}\right)$$

Therefore, the insertion loss can be identified as the module of the scattering parameter $S_{21}$ expressed in dB: $20\ \mathrm{Log}_{10}|S_{21}|$.

Return loss RL: The ratio, expressed in dB, of incident power $P_{in}$ to reflected power $P_r$:

$$RL = 10\mathrm{Log}_{10}\left(\frac{P_{in}}{P_r}\right)$$

Consequently, the return loss is identified in one embodiment as the module of the scattering parameter $S_{11}$ expressed in dB: $20\ \mathrm{Log}_{10}|S_{11}|$. In the case of lossless filters, return loss and insertion loss can be related by the well-known conservative energy equation:

$$|S_{11}|^2+|S_{21}|^2=1$$

Return loss ripple: The ripple of return loss within the bandwidth as FIG. 1 shows.

Insertion loss ripple: The ripple of insertion loss within the bandwidth as FIG. 1 shows.

Bandwidth BW: The bandwidth can be defined in FIG. 1, and it may be related to the position of the return loss ripples. Therefore, it can be called 'equal ripple' bandwidth, analytically expressed from $$BW=f_2-f_1$$

where $f_2$ and $f_1$ are the edges of the bandwidth as indicated in FIG. 1.

Rejection: The out-of-band behavior of the filter.

Poles: The zeros of return loss function within the bandwidth.

One skilled in the art will recognize that other definitions may fall within the scope of this invention and therefore these are given by way of example only.

In many applications, including the present invention, the Chebyscheff response can be used because it offers good performance, e.g., in terms of rejections and compactness. Moreover, the Chebyscheff response is easy to realize with different technologies such a waveguides, strip-lines, or micro-strips. Chebyscheff polynomials can approximate the ideal transfer function of a filter.

Figure 2:
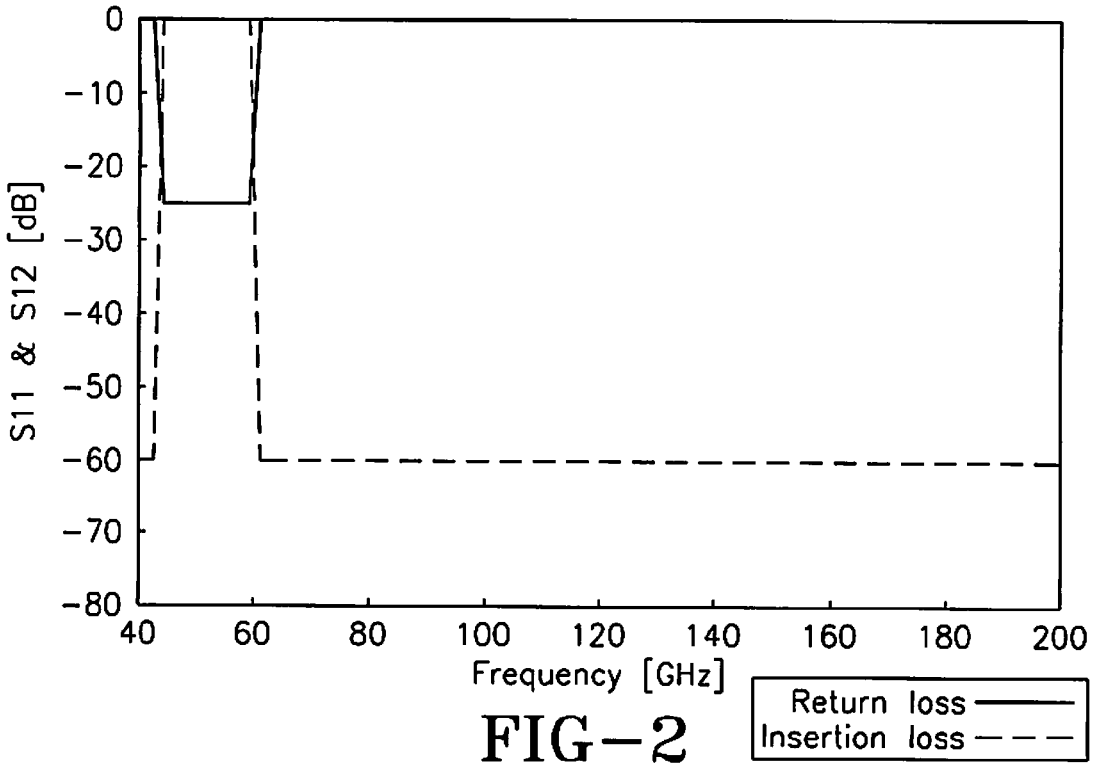
FIG. 2 shows an S parameter goal function for a filter, according to an embodiment.

In at least one embodiment of the invention, a microwave waveguide filter exhibits the following RF specifications: In-band fractional bandwidth of approximately 30%; Highest transmitted frequency approximately 60 GHz; In-band Return Loss ≧20 dB; In-band insertion loss <1 dB; Out-of-band insertion loss ≧60 dB between 63 and 200 GHz; Preservation of both polarization states; and at least −50 dB isolation between the two polarizations. These RF requirements applied to Return and Insertion Losses can be visualised with an S-parameter goal function (mask) as in FIG. 2.

To preserve the polarization states and guarantee the extreme rejection requirements, a single filter structure with four-fold (or higher rotational) symmetry may be used. Four-fold symmetry may mean that, for a transverse cross-section of the structure, the cross-section is symmetric about both the vertical and horizontal axes (i.e., the structure is symmetric under rotation of 90 degrees about its axis). Standard examples of waveguides that exhibit four-fold symmetry are square, quadridge and circular waveguides. However, conventional filters realized with circular and square waveguides offer poor out-of-band rejections because of the intrinsic topology of the structures. In fact, many modes propagate in the frequency range between 40 and 200 GHz, making the attainment of acceptable rejection impossible. The high number of propagating modes translates into the total impossibility of having acceptable rejection in the band of interest through the use of square or circular waveguides.

Figure 3A:
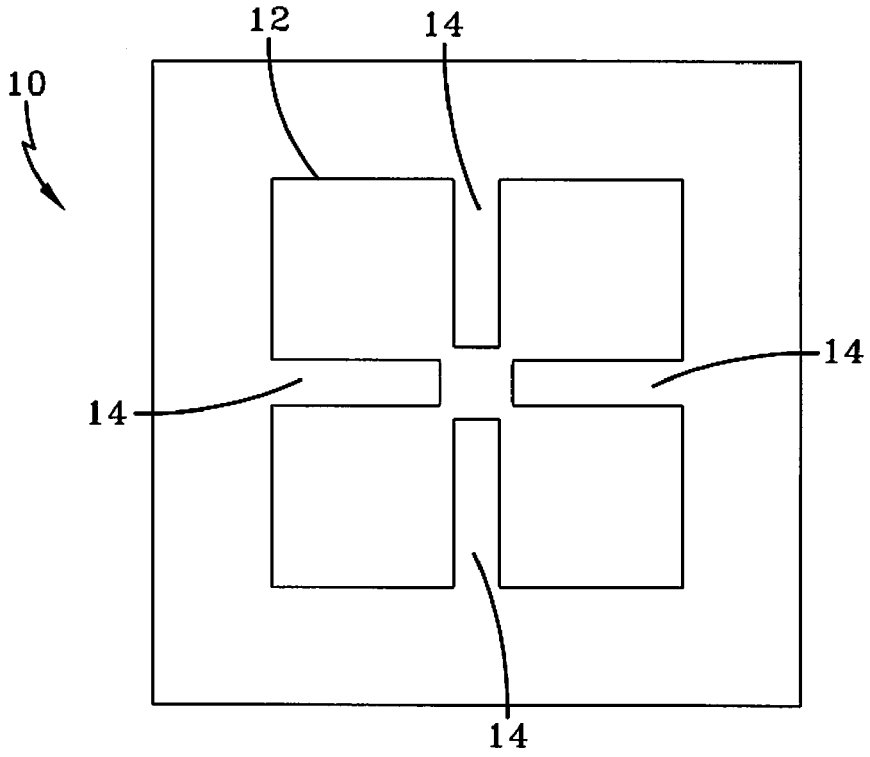
FIGS. 3A and 3B show quadruple ridge cross sections, according to an embodiment.

Quadruple ridge waveguides are known in the literature (Yu Rong, and Kawthar A. Zaki., "Characteristic of Generalized Rectangular and Circular Ridge Waveguides", IEEE Transactions and Microwave Theory and Techniques, Vol. 48, No. 2, February 2000). However, the inventors are not aware of any practical filter design that has been realized with the quadruple ridge waveguides. FIG. 3A shows a rectangular quadruple ridge cross section 10. The section 10 may comprise an interior square perimeter 12 and four ridges 14 that enter deep inside the structure from the center of each face. As known from electromagnetic theory, the cross section can define the propagating modes inside the filter structure. When the dimensions of the cross section are fixed, the cut-off frequencies of the fundamental mode and the higher order modes may be defined. We may employ this configuration to have the output of the device compatible with either a quadruple style OMT or dual detector mounts, depending on the application.

The quadruple ridge cross section 10 can be used to shift the appearance of second order modes to higher frequencies. The introduction of the ridges 14 within the waveguide may result in the shifting of fundamental modes down in frequency, while shifting second order modes higher in frequency. Due to the symmetry, this can happen simultaneously and independently for both polarizations. Thus, the appropriate cross-section design can fix the propagating modes in the structure. As already mentioned, the rejection may preferably be less than 60 dB between 60 and 200 GHz. This may translate in designing the cross-section to have the second propagating mode at 200 GHz.

Figure 4A:
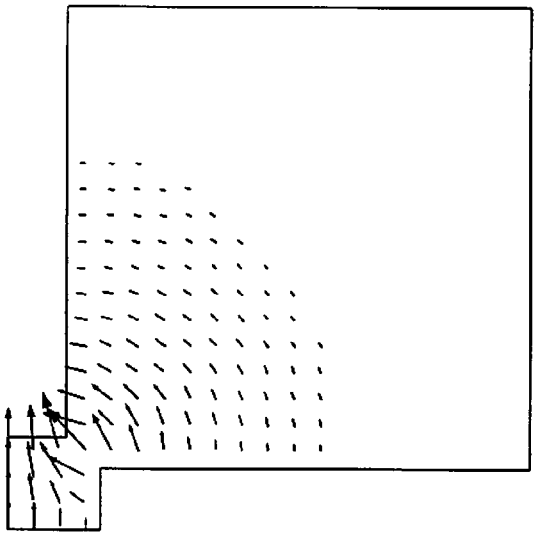
FIGS. 4A and 4B show the electric field lines if the cross section of FIG. 3A is excited with a linearly polarized field (vertical in both directions), according to an embodiment.
Figure 4B:
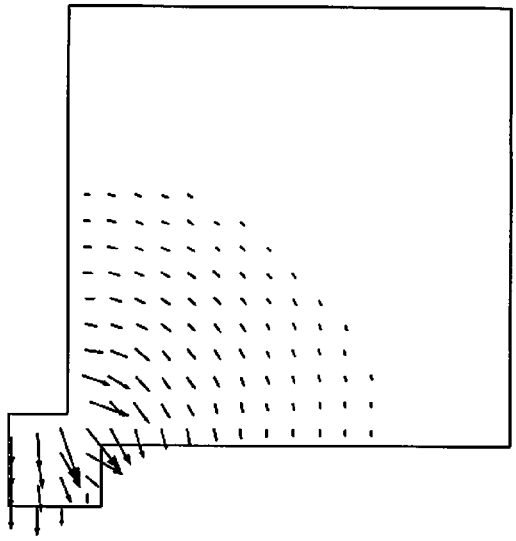
Figure 5A:
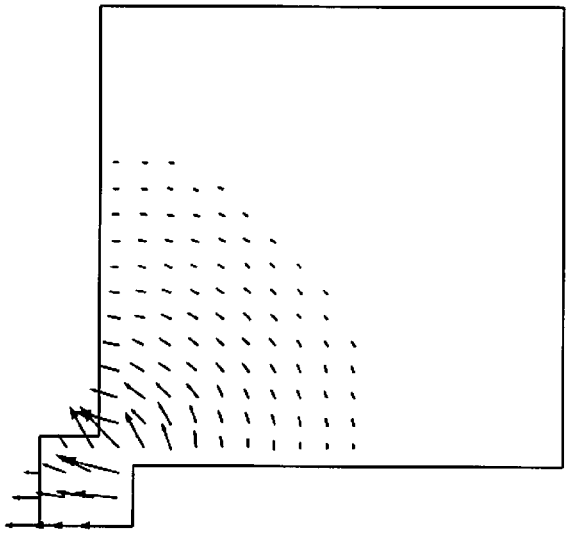
FIGS. 5A and 5B show the electric field lines if the cross-section of FIG. 3A is excited with a linearly polarized field (horizontal in both directions), according to an embodiment.
Figure 5B:
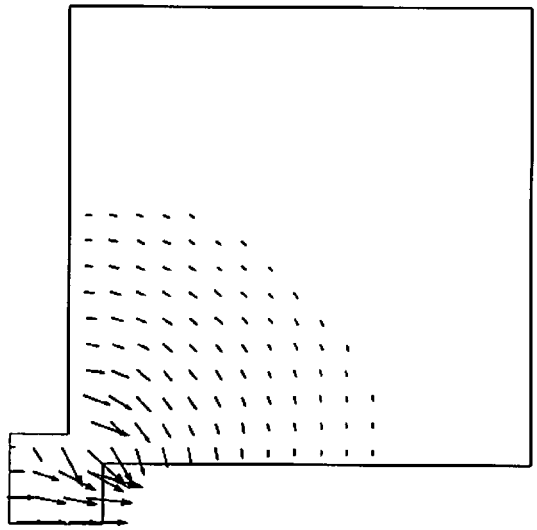

The four-fold symmetry can preserve the dual polarization states of the electromagnetic field. For example, if the cross section is excited with a linearly polarized field (vertical in both directions, the electric field lines may occur in the quadruple waveguide structure as is shown in FIGS. 4A and 4B (one quarter of the structure is shown). FIG. 4A shows the electric field (E-field) lines if excitation is linearly vertically polarized (vector pointing up) and FIG. 4B shows the E-field lines if excitation is linearly vertically polarized (vector pointing down). The field lines may be stronger on the edge of the ridges 14 where the minimum distance within the structure occurs. On the other hand, if the excitation is horizontal linearly polarized, the field's lines will occur in the structure as is shown in FIGS. 5A and 5B (one quarter of the structure is shown). FIG. 5A shows the E-field lines if excitation is linearly horizontally polarized (vector pointing left) and FIG. 5B shows the E-field lines if excitation is linearly horizontally polarized (vector pointing right).

Figure 3B:
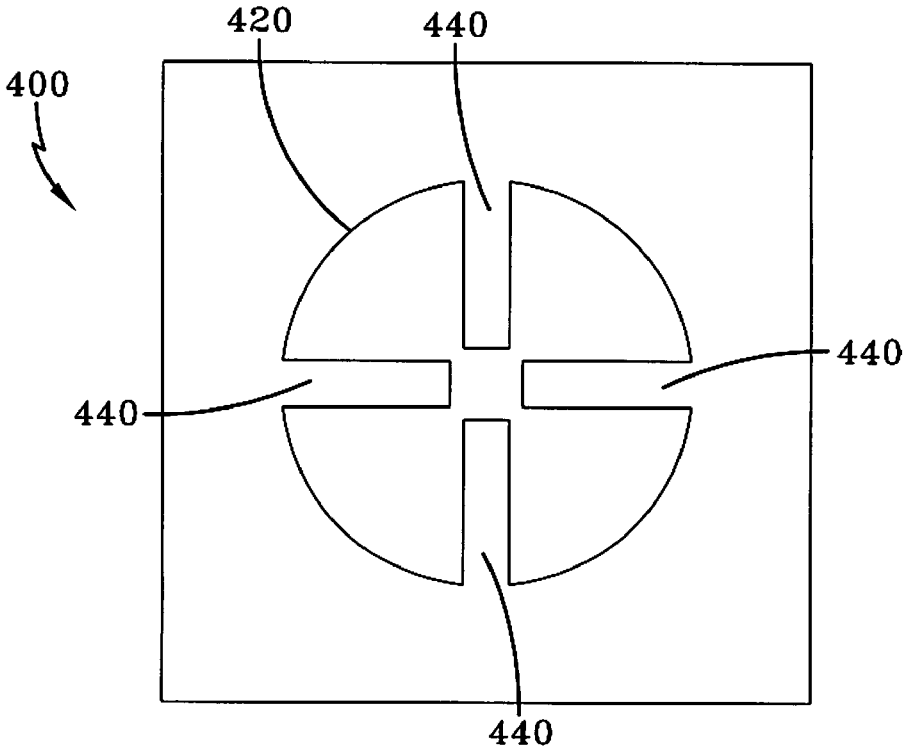

FIG. 3B shows another quadruple ridge cross section 400 having a circular interior perimeter 420 and four ridges 440. The circular quadruple ridge cross section 400 can have four-fold symmetry. The circular quadruple ridge cross section 400 may function similar to the square quadruple ridge cross section 10. That is, the circular quadruple ridge cross section 400 can also preserve the dual polarization states of the electromagnetic field. In addition, when the dimensions of the cross section 400 are fixed, the cut-off frequencies of the fundamental mode and the higher order modes can be defined.

Figure 6:
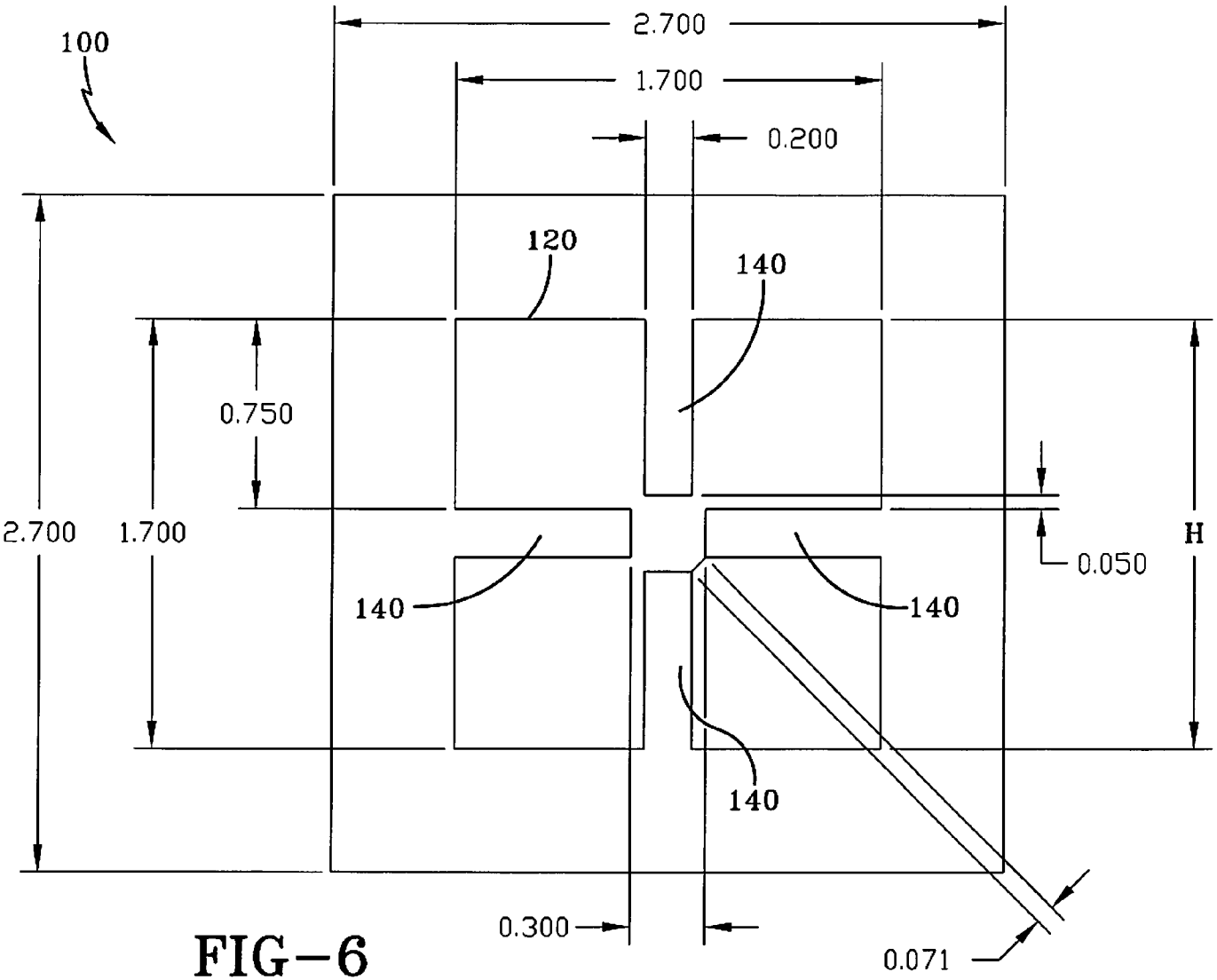
FIG. 6 shows the dimensions of one embodiment of a quadruple ridge cross section.

FIG. 6 shows a specific example of a quadruple-ridge cross section 100 having an interior square perimeter 120 and four ridges 140 with dimensions given in millimeters. The dimensions are exemplary only. Different frequency ranges will require different dimensions. The section 100 can be designed to have the fundamental mode starting at 40 GHz and the second propagating mode at 200 GHz. According to fullwave simulations performed, the section 100 shown in FIG. 6 has the cut-off frequency of the fundamental mode at 39.5 GHz and the second propagating mode at 200 GHz. Thus, the frequency range between 60 and 200 GHz can be entirely occupied only by the fundamental mode.

Figure 7:
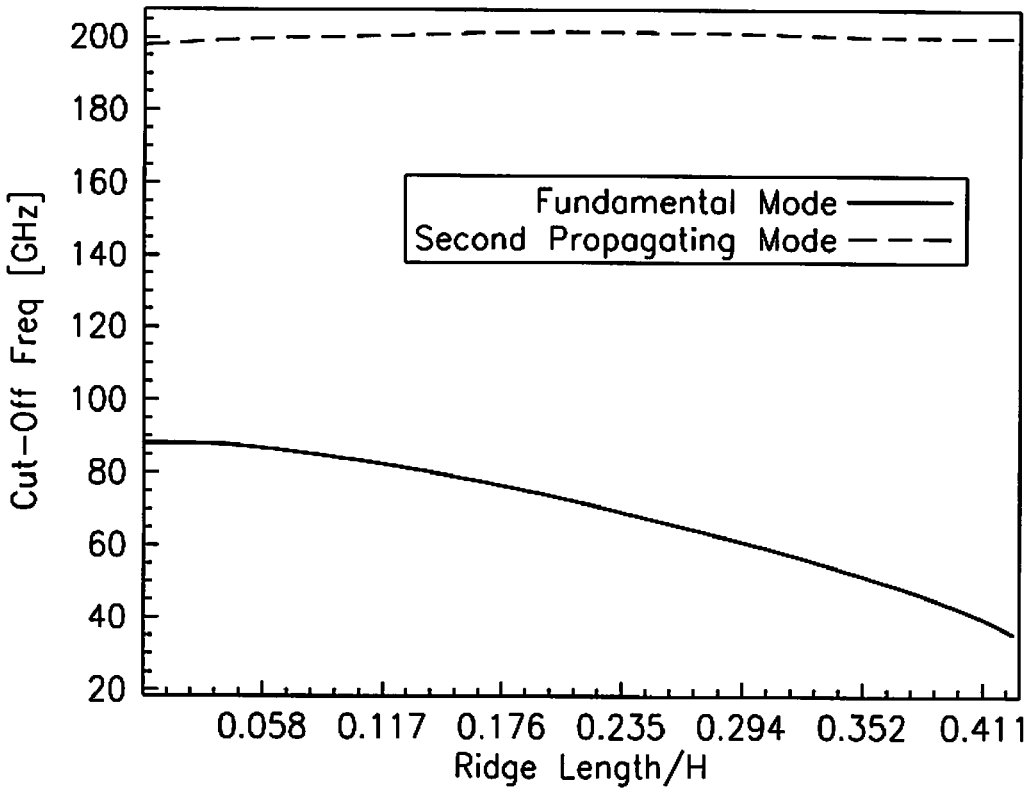
FIG. 7 shows the cut-off frequency of the fundamental mode and the second propagating mode versus the ratio of the ridge length to the housing dimension H in the quadruple ridge cross section of FIG. 6.

FIG. 7 shows the cut-off frequency of the fundamental mode and the second propagating mode versus the ratio of ridge length to the interior housing dimension H in the quadruple ridge cross section 100 of FIG. 6. The cut-off frequency of the fundamental mode can vary in frequency from 88 GHz to 35 GHz with ratios of ridge length/H that vary from 0 to 0.435 mm. On the other hand, the cut-off frequency of the second propagating mode may be (surprisingly) approximately constant at 200 GHz.

Figure 8:
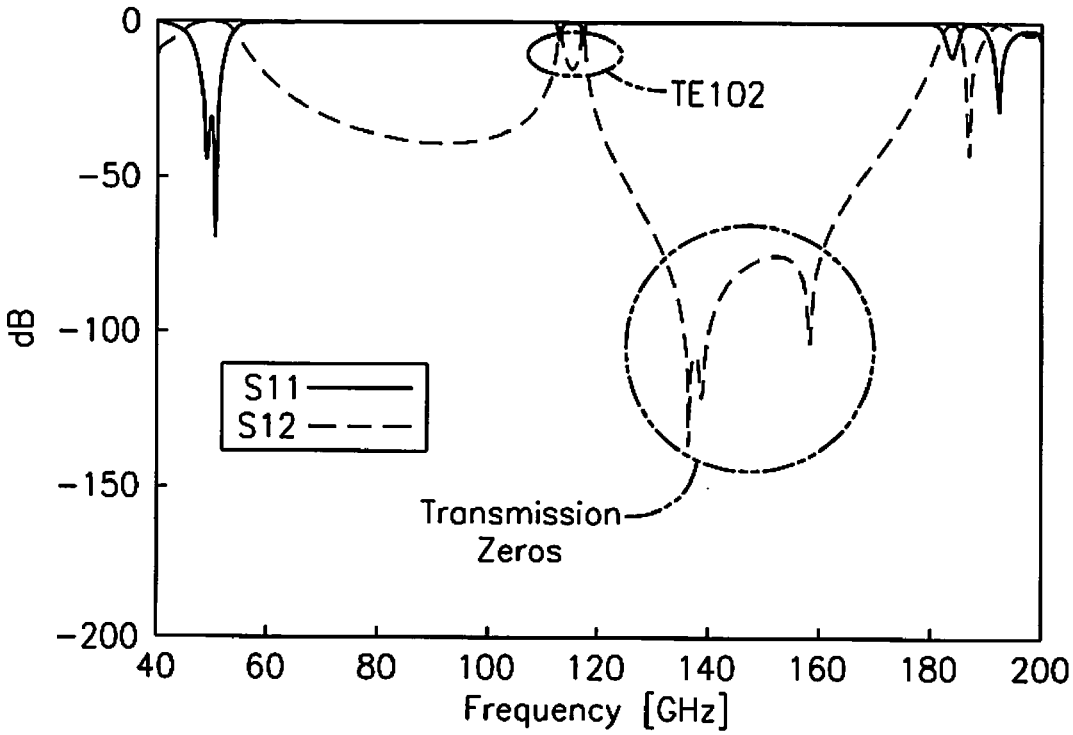
FIG. 8 shows the S-parameter response for a 2-pole filter.
Figure 9:
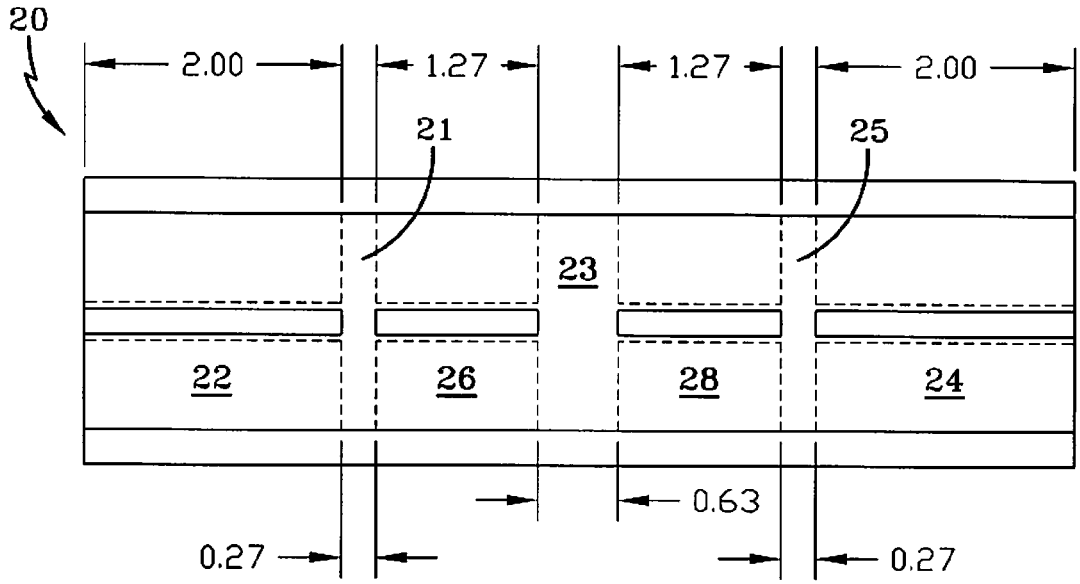
FIG. 9 is a longitudinal view of a 2-pole filter.

Using the quadruple-ridge cross-section 100 shown in FIG. 6, at least one embodiment of the invention is a 2-pole filter 20 with the following RF specs: 2-pole filter design; 49.775 GHz center frequency; In band return loss of 25 dB; and Fractional bandwidth of 5.8%. FIG. 8 shows the S-parameter response for the 2-pole filter 20. Zeros of transmission may be also evident in the filter response. FIG. 8 was generated using mode-matching code with the S-parameters normalized to the wave impedance of the quadruple ridge waveguide. The structure of 2-pole filter 20 is shown in FIG. 9 with dimensions in millimeters. The dimensions are exemplary only. Different frequency ranges will require different dimensions. The cross-section 100 of the filter 20 is four-fold symmetric.

Waveguide filter 20 may include an input waveguide section 22; an output waveguide section 24; a plurality of resonator sections 26, 28 disposed between the input and output waveguide sections 22, 24; and a plurality of coupling sections 21, 23, 25 disposed on either side of each of the resonator sections 26, 28. The input waveguide section 22, the resonator sections 26, 28, and the output waveguide section 24 may have generally square, quadruple ridge cross-sections 100 (FIG. 6). The coupling sections 21, 25 may have generally square, "empty" cross-sections, that is, the sections 21, 25 may comprise the section 100 of FIG. 6 without the four ridges 140. The waveguide filter 20 can be four-fold symmetric.

Figure 10:
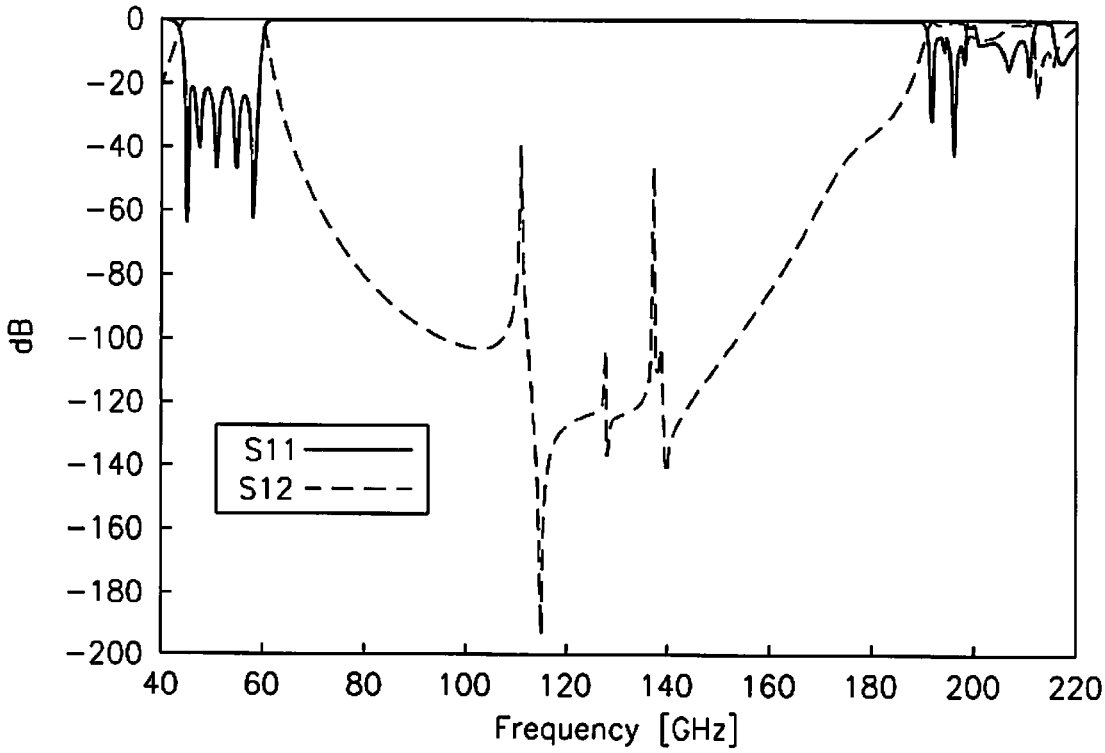
FIG. 10 shows the S-parameter response for a 6-pole filter.
Figure 11:
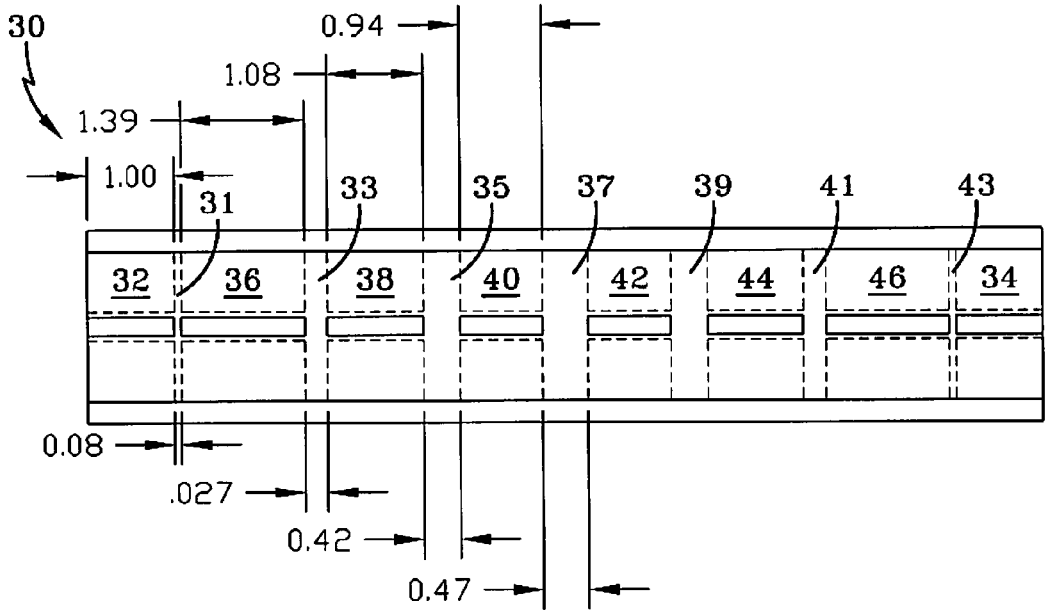
FIG. 11 is a longitudinal view of a 6-pole filter.

Using the quadruple-ridge cross-section 100 shown in FIG. 6, another embodiment of the invention may be a 6-pole filter 30 with the following RF specs: 6-pole filter; center frequency of 51.9 GHz; In band return loss of 25 dB; and Fractional bandwidth of 27%. FIG. 10 shows the S-parameter response for the 6-pole filter 30. The filter repletion can be attenuated by the zero of transmission shown in FIG. 10. FIG. 10 was generated using mode-matching code with the S-parameters normalized to the wave impedance of the quadruple ridge waveguide. The structure of 6-pole filter 3 is shown in FIG. 11 with dimensions in millimeters. The dimensions are exemplary only. Different frequency ranges will require different dimensions. The structure of the filter 30 can be four-fold symmetric.

Waveguide filter 30 may include an input waveguide section 32; an output waveguide section 34; a plurality of resonator sections 36, 38, 40, 42, 44, 46 disposed between the input and output waveguide sections 32, 34; and a plurality of coupling sections 31, 33, 35, 37, 39, 41, 43 disposed on either side of each of the resonator sections 36, 38, 40, 42, 44, 46. The input waveguide section 32, the resonator sections 36, 38, 40, 42, 44, 46 and the output waveguide section 34 may have quadruple ridge cross-sections 100 (FIG. 6). The coupling sections 31, 33, 35, 37, 39, 41, 43 may have "empty" generally square cross-sections, that is, the sections 31, 33, 35, 37, 39, 41, 43 can comprise the section 100 of FIG. 6 without the four ridges 140. The waveguide filter 30 can be four-fold symmetric.

FIG. 11 shows that the length of the first input coupling 31 may be very small (0.078 mm), making it difficult to fabricate. The length of the first input coupling 31 can be important because it determines the in-band return loss. A solution to overcome the problem of the small first input coupling length is discussed later.

Figure 12:
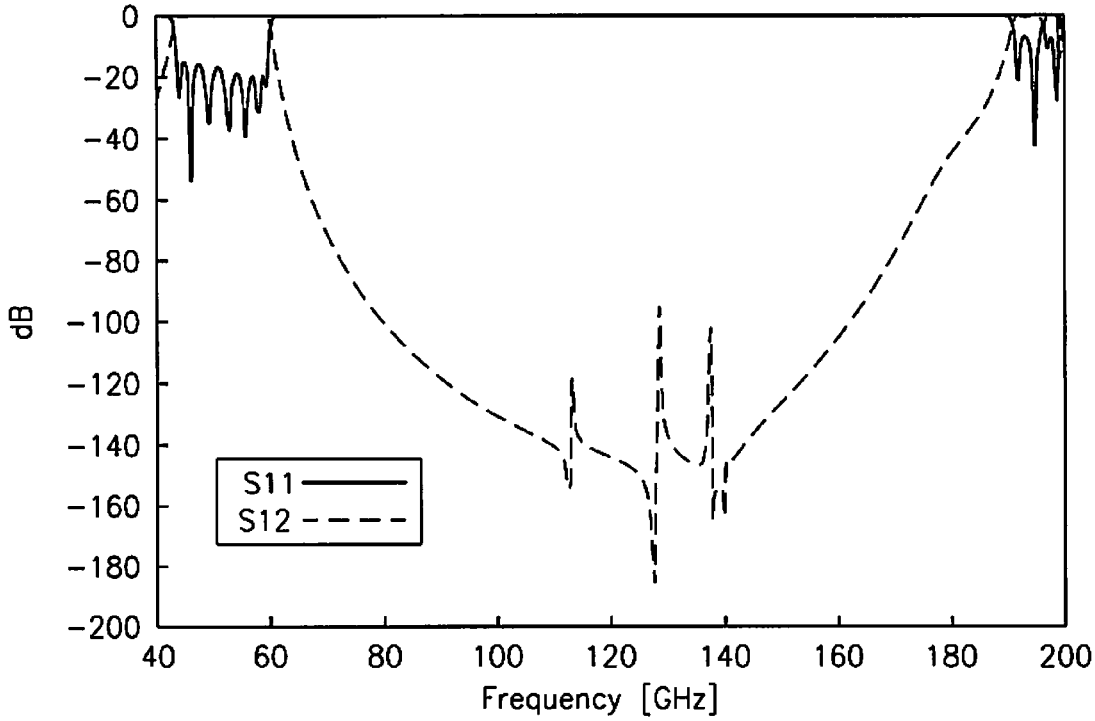
FIG. 12 shows the S-parameter response for a 7-pole filter.
Figure 13:
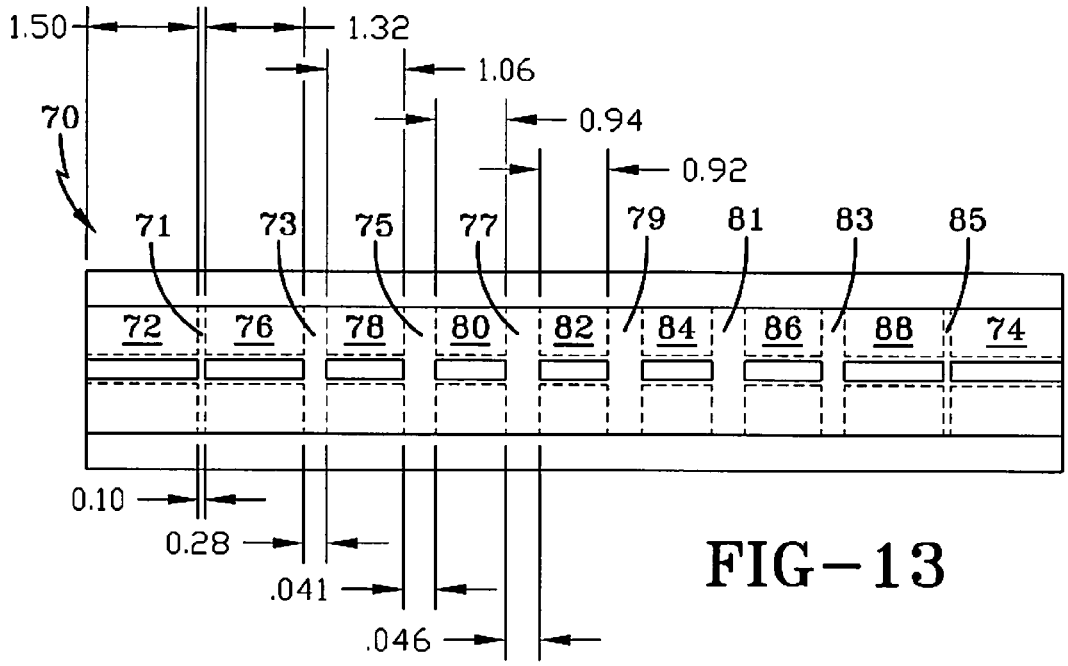
FIG. 13 is a longitudinal view of a 7-pole filter.

Using the quadruple-ridge cross-section 100 shown in FIG. 6, still another embodiment of the invention may be a 7-pole filter 70 with the following RF specs: 7-pole filter; center frequency of 51.6 GHz; In band return loss of 20 dB; and Fractional bandwidth of 30%. FIG. 12 shows the S-parameter response for the 7-pole filter 70 where the repetition of the fundamental mode is clearly attenuated (attenuation loss better than −60 dB in the out of band frequency range). FIG. 12 was generated using mode matching code with the S-parameters normalized on the wave-impedance of the quadruple ridge waveguide. The structure of the 7-pole filter 70 is shown in FIG. 13 with dimensions in millimeters. The dimensions are exemplary only. Different frequency ranges will require different dimensions. The structure of the filter 70 can be four fold symmetric.

Waveguide filter 70 may include an input waveguide section 72; an output waveguide section 74; a plurality of resonator sections 76, 78, 80, 82, 84, 86, 88 disposed between the input and output waveguide sections 72, 74; and a plurality of coupling sections 71, 73, 75, 77, 79, 81, 83, 85 disposed on either side of each of the resonator sections 76, 78, 80, 82, 84, 86, 88. The input waveguide section 72, the resonator sections 76, 78, 80, 82, 84, 86, 88 and the output waveguide section 74 may have quadruple ridge cross-sections 100 (FIG. 6). The coupling sections 71, 73, 75, 77, 79, 81, 83, 85 may have generally square "empty" cross-sections, that is, sections 71, 73, 75, 77, 79, 81, 83, 85 comprise the section 100 of FIG. 6 without the four ridges 140. The waveguide filter 70 can be four-fold symmetric.

Figure 14A:
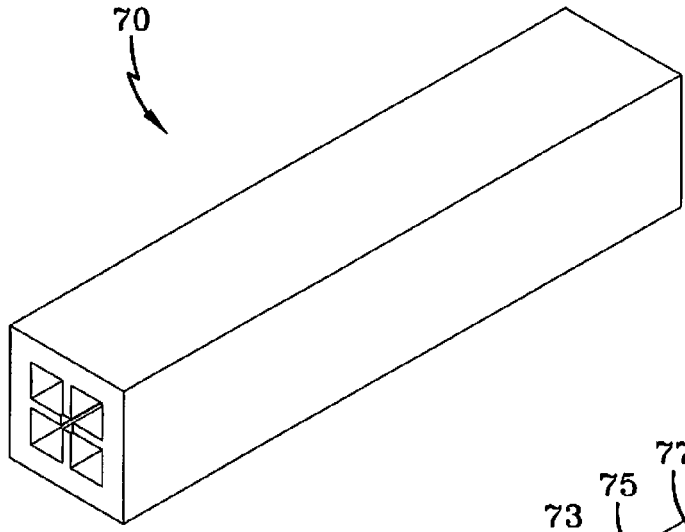
FIG. 14A is a perspective view of a 7-pole filter.
Figure 14B:
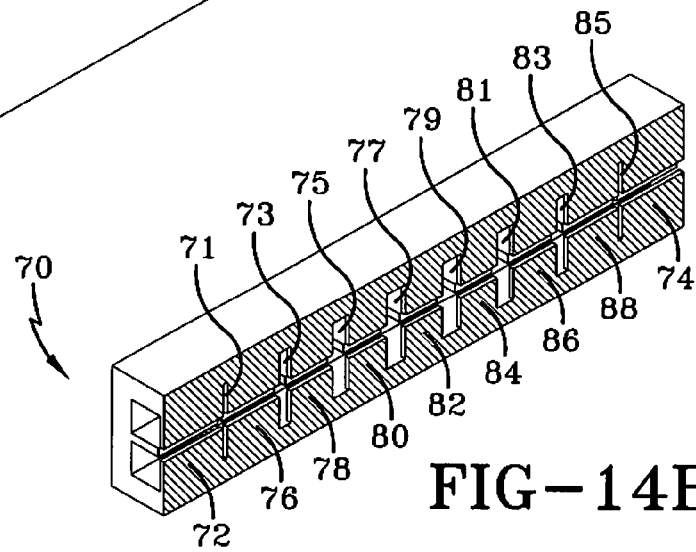
FIG. 14B is a perspective, cutaway view of the 7-pole filter of FIG. 14A with a vertical cutting plane.
Figure 14C:
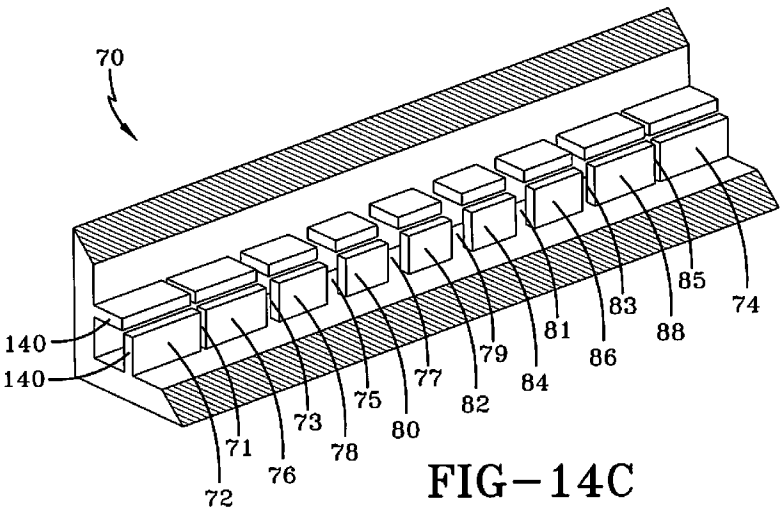
FIG. 14C is a perspective, cutaway view of the 7-pole filter of FIG. 14A with a 45 degree angle cutting plane.
Figure 15:
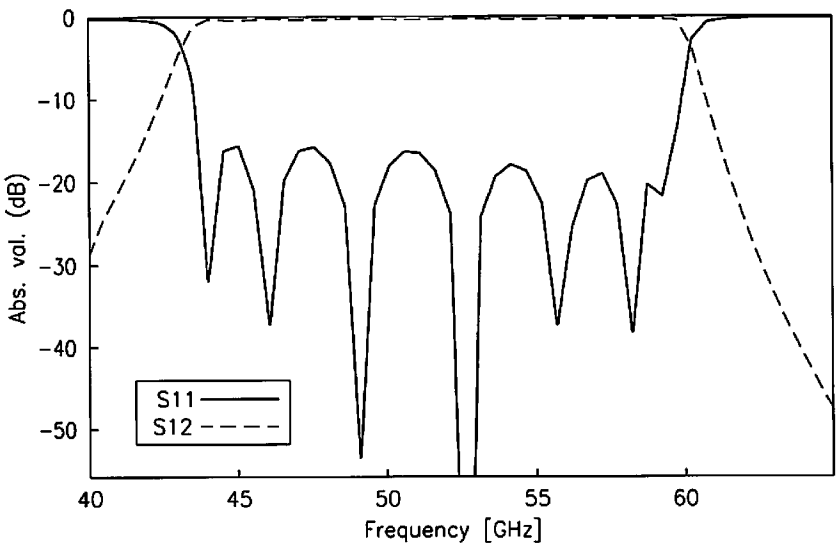
FIG. 15 is an enlarged view of a portion of FIG. 12 showing the in-band response.

FIG. 14A is a perspective view of the 7-pole filter 70. FIG. 14B is a longitudinal section of FIG. 14A. FIG. 14C is a section created by slicing FIG. 14A at a 45 degree angle. As seen in FIG. 14C, the propagating waveguide sections (resonator sections) 76, 78, 80, 82, 84, 86, 88 may be separated by the evanescent coupling sections 71, 73, 75, 77, 79, 81, 83, 85. The propagating waveguides 76, 78, 80, 82, 84, 86, 88 can behave as resonators, while the first and the last waveguides 72, 74 can represent the input and output waveguides of the filter 70. FIG. 15 is an enlarged view of a portion of FIG. 12 and shows the in-band S-parameter response. As illustrated, the bandwidth can extend from 43.7 to 59.5 GHz, the center frequency may be 51.6 GHz, and the fractional bandwidth may be approximately 30%.

In each illustrated embodiment 20, 30, 70 of the inventive filter, the lengths of the coupling sections are shown to decrease from the midpoint of the filter towards both ends. However, there may be embodiments wherein the coupling sections and input and output waveguides have differing cross sections and the lengths do not always decrease from the midpoint of the filter towards both ends. Also, in the filters 20, 30, 70, the lengths of the resonator sections increase from the midpoint of the filter towards both ends. However, there may be embodiments wherein the resonator sections have differing cross sections and the lengths do not always increase from the midpoint of the filter towards both ends.

From the fullwave simulations on the three filters 20, 30, 70, the following results were noted. These results are shown by way of example only at 50 GHz, the resonant mode TE101 creates the filter response. Around 110 GHz, one "spike" appears for each resonator and the repetition of the fundamental mode TE102 (FIG. 8) appears. The higher the filter order, the more the repetition of the fundamental mode TE102 is suppressed. The spikes may b a function of the bandwidth of the filter and the lengths of its resonators. Increasing the order of the filter may increase the number of zeros of transmissions. The second propagating mode may appear as foreseen from the design of the quadruple-ridge cross section 100 (FIG. 6). The repetition of the fundamental mode can be suppressed by increasing the filter order. The second propagating mode (TE301) starts at 200 GHz.

As shown in the simulations, the repetition of the fundamental mode (mode TE102) may be suppressed by increasing the number of poles in the filter. It should be noted that this result of "killing" the repetition of the fundamental mode by increasing the filter order may be a property of the invention and does not appear to occur in standard waveguide structures. The seven-pole filter 70 may comply with the rejection requirements, adequately suppressing the repetition of the fundamental mode occurring at 110 GHz, as shown in FIG. 12. It may be seen that rejection can be quite good until about 200 GHz, where the second mode appears as predicted.

The filter embodiments 20, 30, 70 of the invention can be obtained by properly adjusting the length of each section (quadruple-ridge and evanescent section). In particular, the input coupling section (71 in FIGS. 13, 14B and 14C) can contribute to determining an adequate in-band return loss, which is better than 15 dB in the whole frequency range. To have better return loss, the first evanescent section 71 may be smaller in length.

Figure 16:
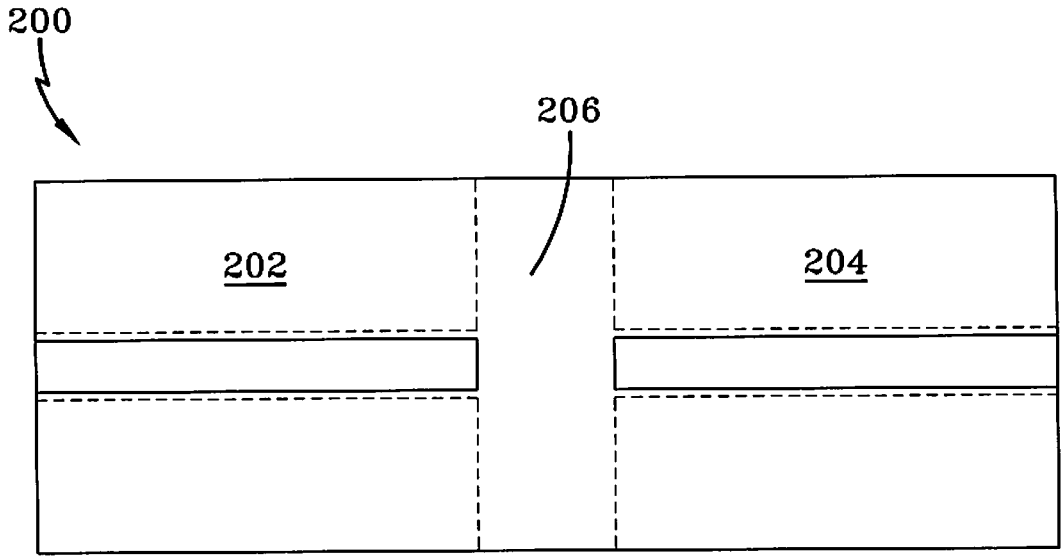
FIG. 16 is a longitudinal view of two rectangular quadruple ridge sections (input-output) separated by an evanescent section.
Figure 17:
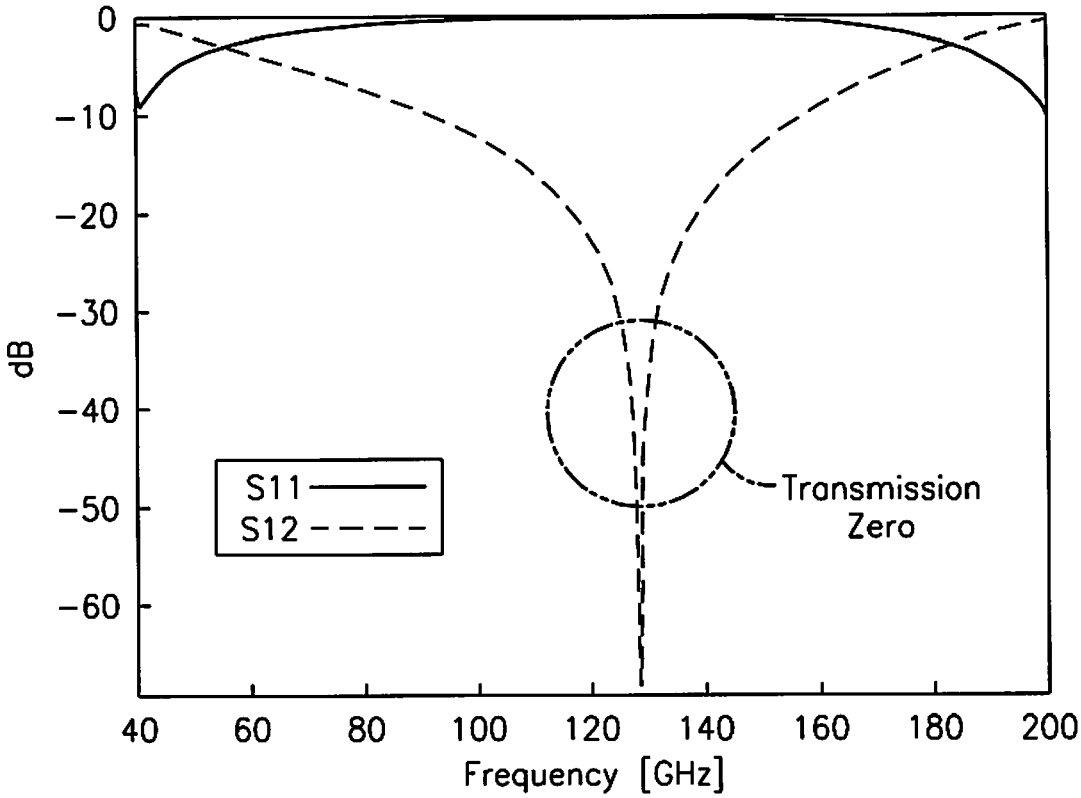
FIG. 17 shows the S-parameter response of the structure shown in FIG. 16.

To understand the phenomena of higher order mode suppression, it may be necessary to study the elementary contribution of each evanescent section. Each evanescent section can introduce a zero of transmission in the frequency-range of interest. By fullwave simulating a structure 200 (FIG. 16) composed of two four fold symmetric quadruple ridge sections 202, 204 (input-output) separated by a four fold symmetric evanescent section 206, an interesting result can be found. FIG. 17 shows the S-parameter response of the four fold symmetric evanescent section 206. A transmission zero is introduced in the out-of-band frequency range. The position of the transmission zero may depend only on the length of the evanescent section 206. Therefore, the zero may change its position in frequency according to the length of the evanescent section 206.

The transmission zero can be generated because the coupling section 206 (with a width of approximately $\lambda g/4$) may behave as a stab for the electromagnetic field. This result appears to be consistent with what is observed in the filter design. For each evanescent section, a zero of transmission can be created. Therefore, these zeros can be the basic mechanism for the higher order mode suppression; the higher the filter order, the higher the number of zeros, which translates into stronger suppression. Thus, the zeros of transmission, due to the evanescent sections, can be the cause of the suppression of the higher order mode.

The results illustrated in FIG. 15 show the in-band return loss better than 15.6 dB in the frequency range of interest. This return loss level could be "fixed" by the smallest length within the filter, the first coupling section 71 of FIG. 13. In other words, if this length becomes smaller, an improved return loss (as good as 25 dB) may be achieved.

Figure 18:
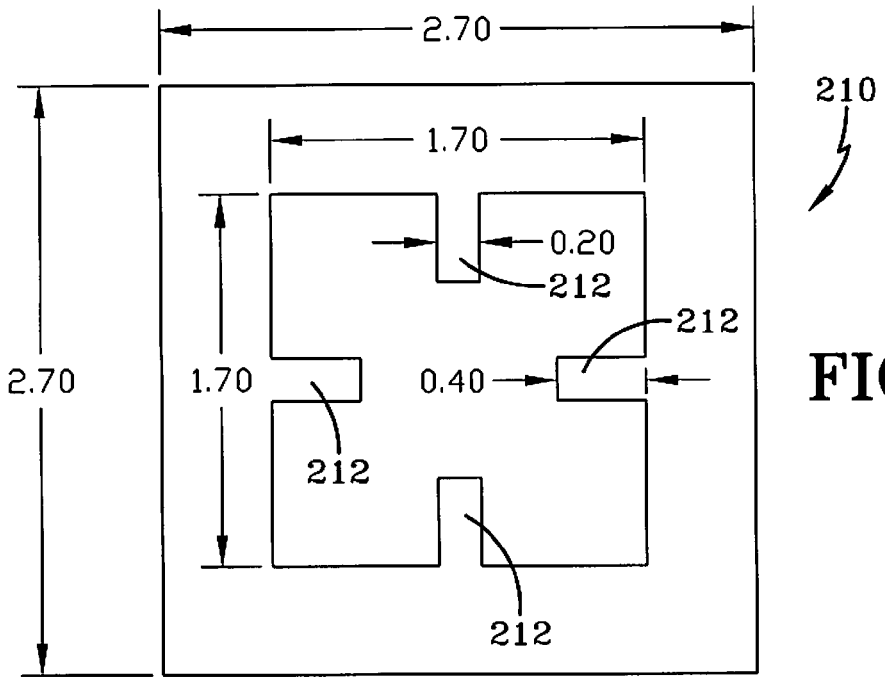
FIG. 18 is a cross section of a rectangular quadruple-ridge section with dimensions in millimeters.

In yet another embodiment of the invention, the first input coupling section 71 of FIG. 13 may be replaced with a quadruple-ridge section 210 (FIG. 18) having ridges 212. The ridges 212 can have a smaller ridge length (the distance from the interior perimeter radially inward to the end of the ridge) than the ridges 14 of the quadruple-ridge section 100 shown in FIG. 6, because section 210 must evanesce to provide the right coupling. The length (along the longitudinal axis of the filter) of the replacement quadruple-ridge section 210 cannot be further reduced because of fabrication problems. The first four fold symmetric evanescent section 71, therefore, may be substituted with a four fold symmetric quadruple-ridge section 210 under cut-off. FIG. 18 is a cross section of the four fold symmetric quadruple-ridge section 210 with dimensions in millimeters. The dimensions are exemplary only. Implementations for differing frequency ranges will require different dimensions.

Figure 19:
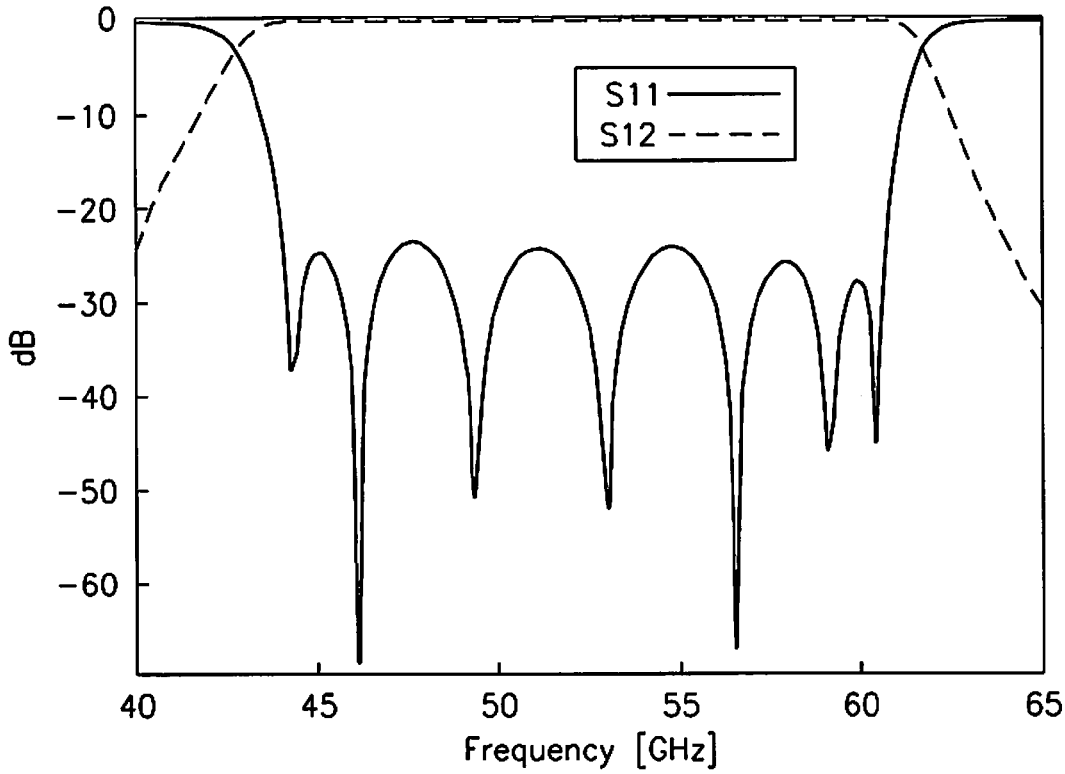
FIG. 19 shows the in-band return loss using the quadruple-ridge section of FIG. 18. substituted for the first input coupling section and after some fullwave optimization.

The section 210 may have a cut-off frequency of the fundamental mode at 69.2 GHz. Because the field is concentrated in the vicinity of the ridges 212, the introduction of the quadruple-ridge section 210 can make a stronger coupling and "relaxes" the coupling length. Thus, it may be possible to achieve a 25 dB return loss with a minimum width of about 0.2 mm (double the 0.1 mm width of coupling section 71) using this method. FIG. 19 shows the in-band return loss with the section 210 substituted for the first input coupling section 71.

Figure 20:
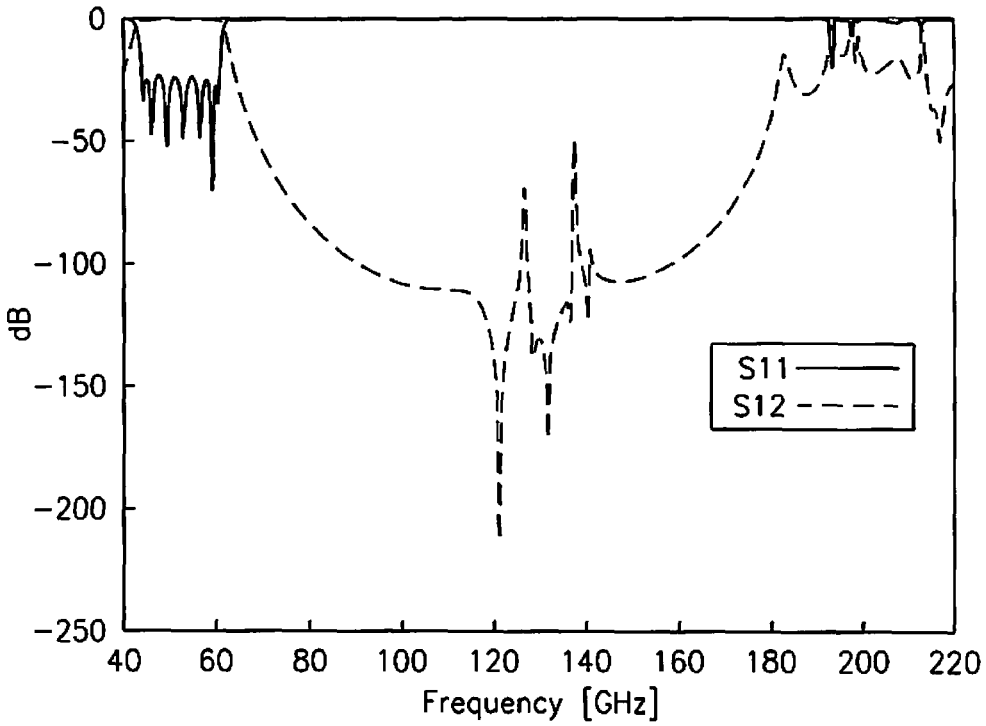
FIG. 20 shows the response using the quadruple-ridge section of FIG. 18, in a wider frequency range than FIG. 19.

On the other hand, by substituting the quadruple-ridge section 210 for the first evanescent section 71, two important zero of transmissions may be lost. Therefore, the rejection in the frequency range of interest can slightly deteriorate. FIG. 20 shows the response in a wider frequency range. The deterioration may be overcome by increasing the filter order to reach the desired attenuation.

The 7-pole filter 70 may meet the RF requirements and handle both polarization states of the electromagnetic field. However, the frequency response of the filter can be tested using standard waveguides. The standard waveguide WR 19 (4.775×2.388 mm) has an operative frequency between 40 GHz and 60 GHz, which coincides with the specifications of the proposed filter. However, to preserve the minimum four-fold symmetry, a WR 19 with dimensions of 4.775×4.775 mm may serve as a standard for testing the inventive quadruple ridge waveguide filter.

A transformer between the inventive filter and the WR 19 may be necessary to allow measurements of frequency response that can be tested against a standard. The transformer should maintain the same minimum four-fold symmetry employed in both the WR 19 (4.775×4.775 mm) and the filter. The summary requirements of the transformer may be: Bandwidth: 40-60 GHz; Return loss: >20 dB within bandwidth; and Transform filter cross-section into: 4.775×4.775 mm.

One way to achieve the required bandwidth may be to connect the filter directly to the 4.775×4.775 mm housing. Network theory states that connecting two ports with different impedance ratios should be progressive and not abrupt. In this case, the tested impedance ratio between the filter and the WR 19 is about 7 (as confirmed through simulations with a commercial software tool). This impedance ratio is extremely high. Therefore, one method to preserve the bandwidth while matching the impedance (achieve the required return loss) may be by introducing tapered ridges within the transformer. The tapering may progressively match the impedances between the WR 19 and the inventive filter. In addition, there is still the requirement of maintaining at least four-fold symmetry.

Figure 21A:
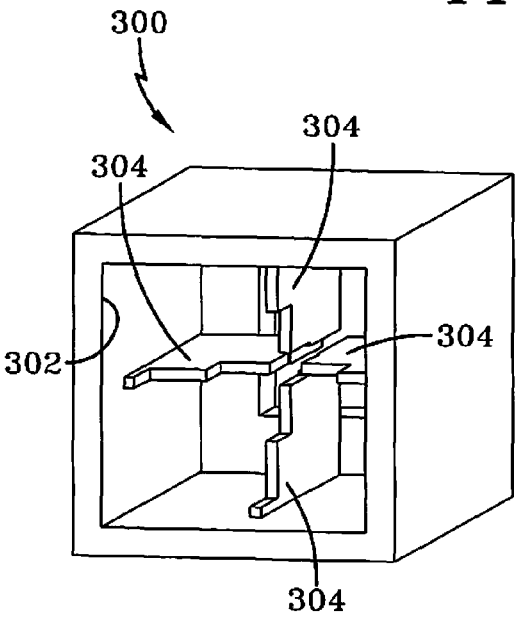
FIG. 21A is a perspective view of one embodiment of a transformer.
Figure 21B:
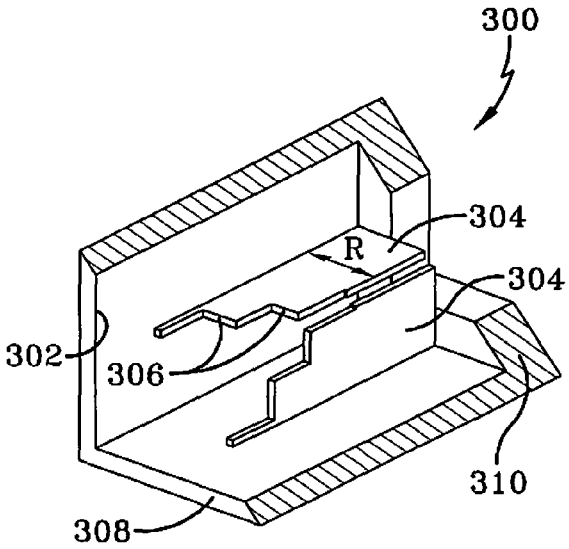
FIG. 21B is a perspective view of the transformer of FIG. 21A with a cut plane at 45 degrees.

FIG. 21A is a perspective view of one embodiment of a transformer 300 with first and second ends 308, 310. FIG. 21B is a perspective view of the transformer 300 of FIG. 21A with a cut plane at 45 degrees. Transformer 300 may comprise a housing with an interior generally square four fold symmetric perimeter 302 and four ridges 304 disposed at ninety degree intervals inside the perimeter 302. Each ridge 304 may include a series of steps 306 such that the ridge length R (FIG. 21B) increases along the longitudinal axis of the housing. The opening in the second end 310 of the housing may be sized to encompass the filter housing.

Figure 22:
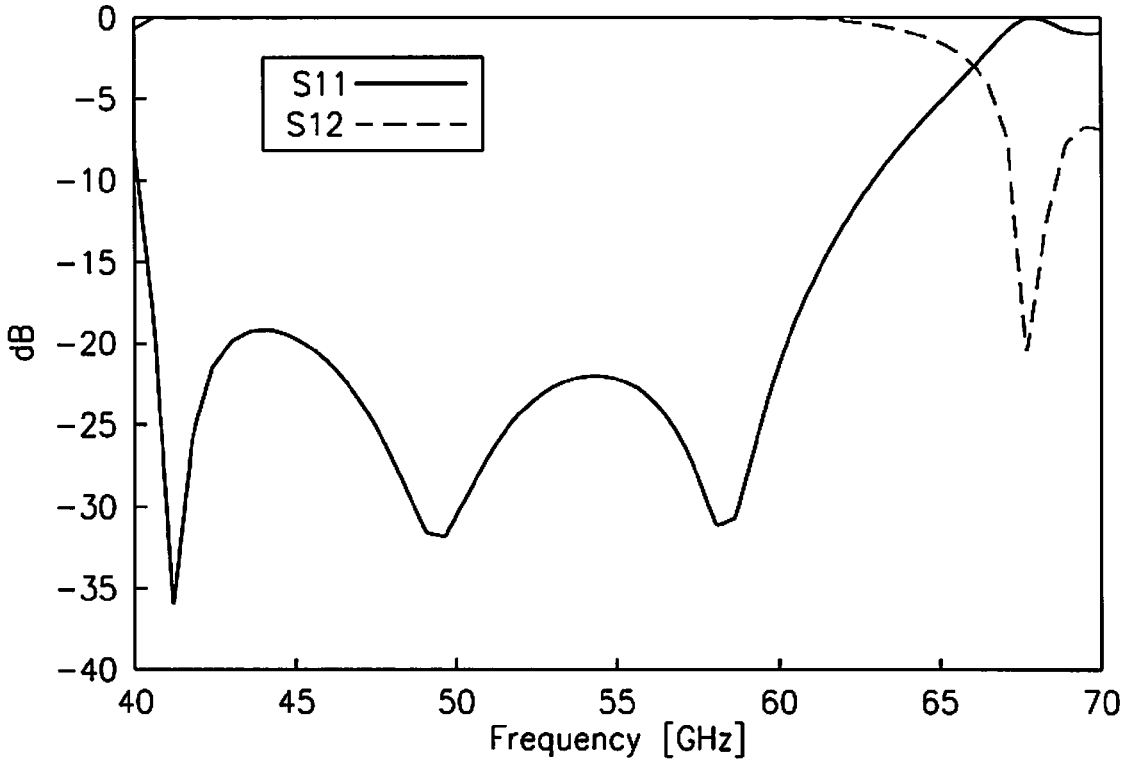
FIG. 22 shows the S parameter response of the transformer.

A transformer 300 may be directly connected to each end of the filter. To improve the return loss, additional tapered ridges 304 may be used within the transformer 300. FIG. 22 shows the S parameter response of the transformer 300. There is a noticeable similarity to the S parameter response of a low pass filter. It can be noted that after 65 GHz the square rectangular waveguide is not mono-mode.

Figure 23:
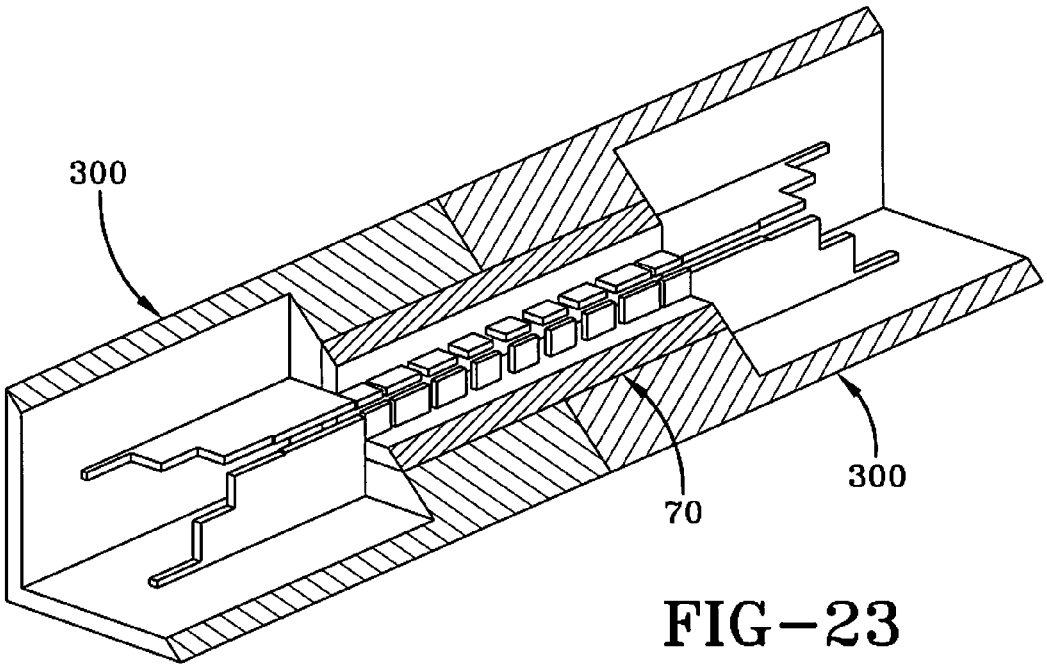
FIG. 23 is a perspective view of the filter and transformer assembly with a cut plane at 45 degrees.
Figure 24:
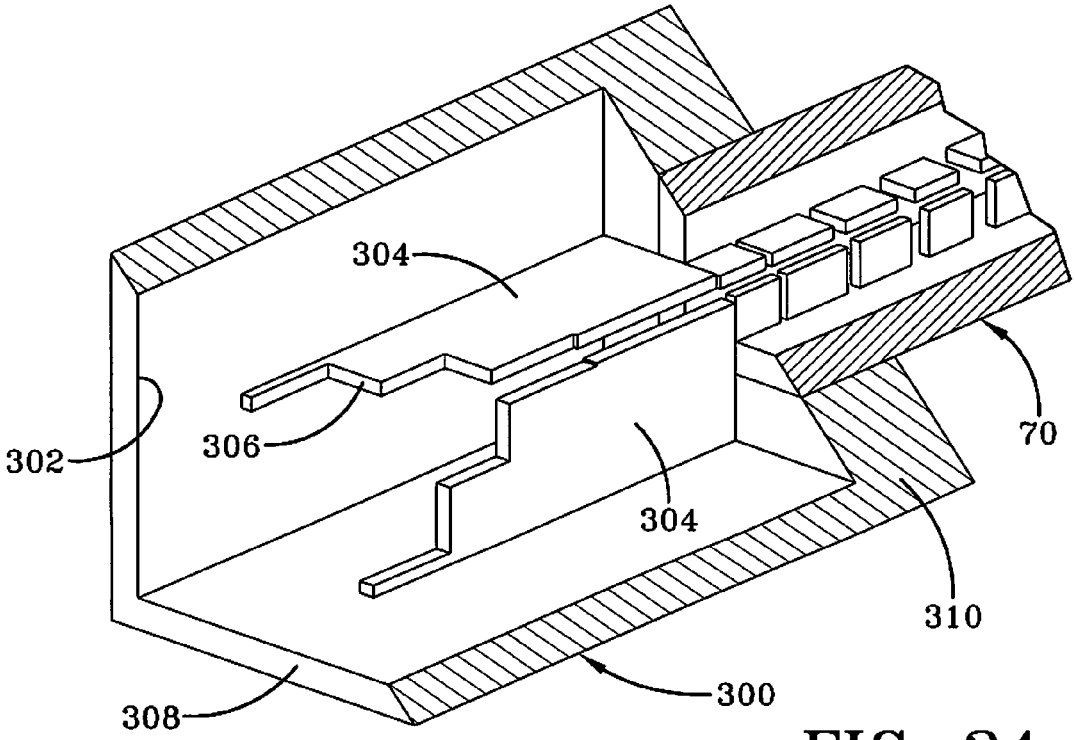
FIG. 24 is an enlarged view of the connection between the transformer and the filter.
Figure 25:
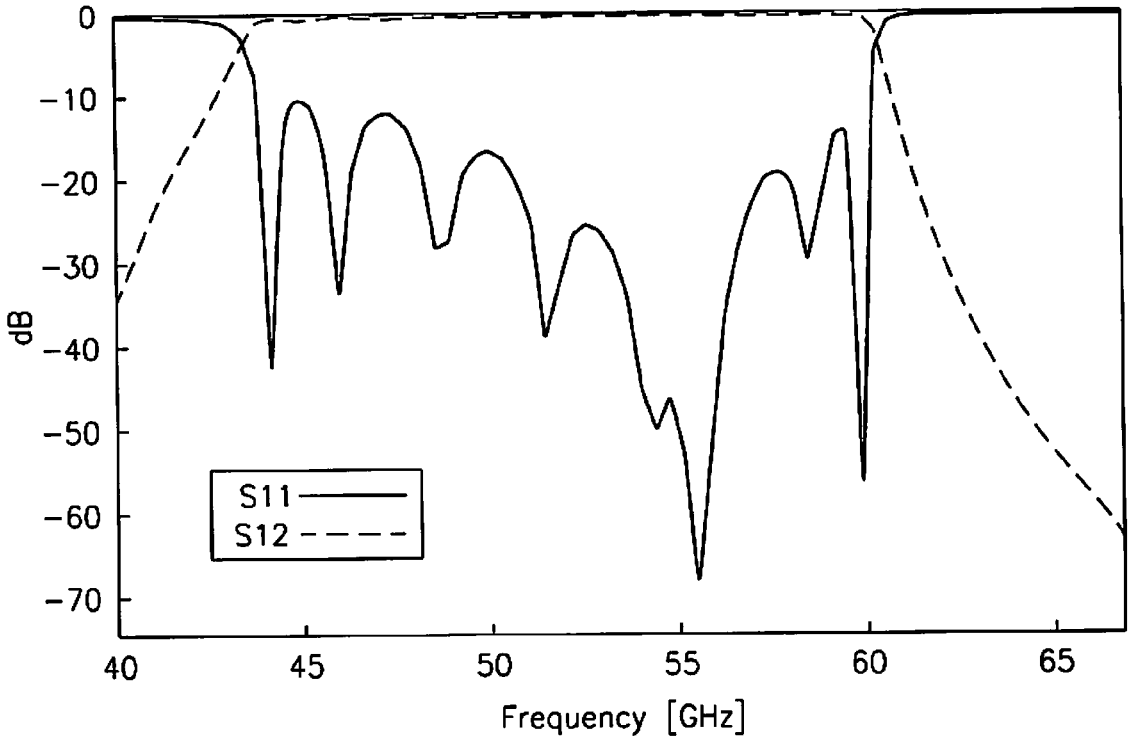
FIG. 25 shows the in-band response of the filter and transformer assembly of FIG. 24 before full wave optimization.
Figure 26:
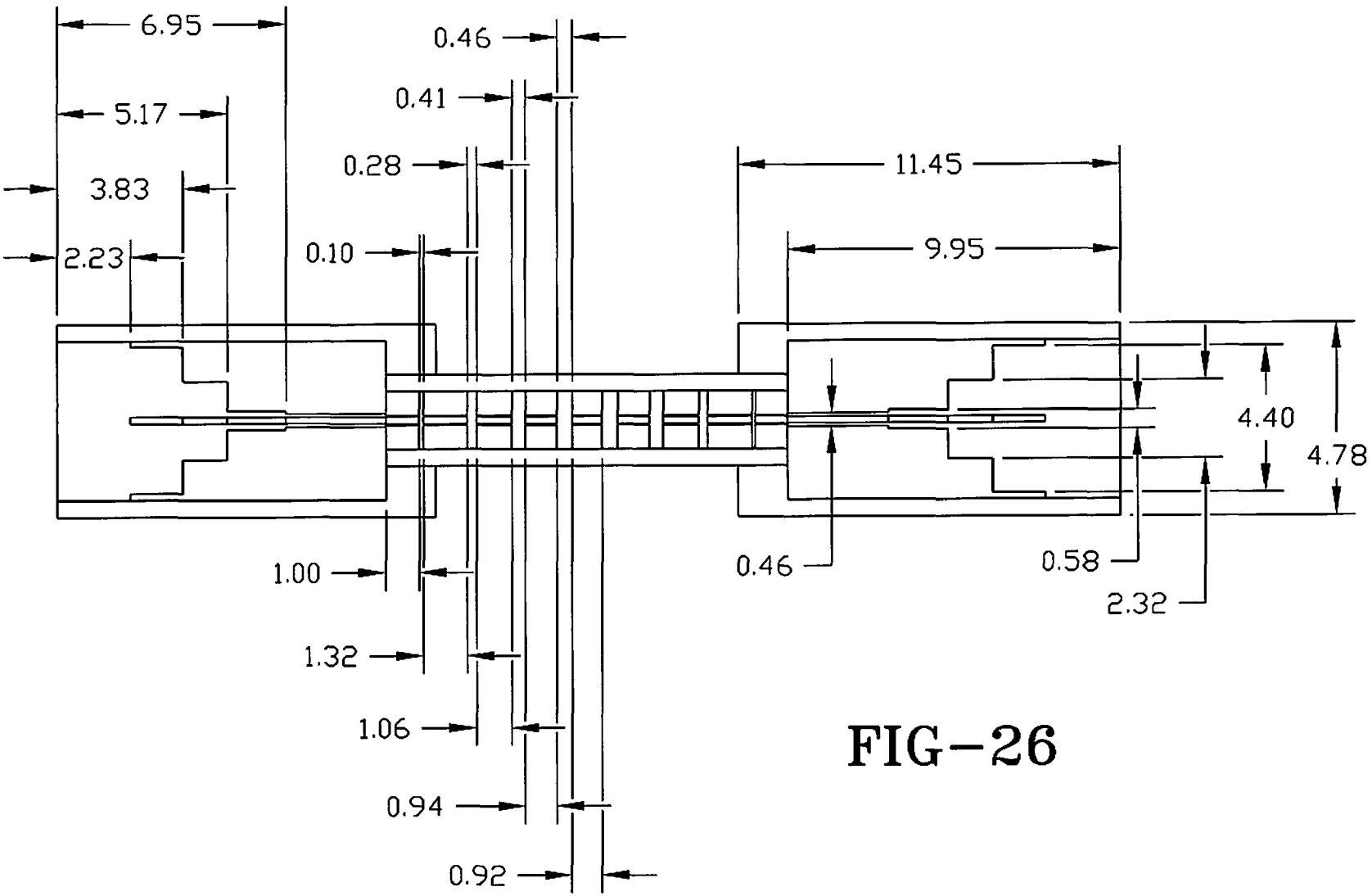
FIG. 26 is a longitudinal view of the filter and transformer assembly with dimensions in mm, before fullwave optimization and before the ridge section of FIG. 18 is added.

FIG. 23 is a perspective view of the filter 70 and transformer 300 with a cut plane at 45 degrees. FIG. 24 is an enlarged view of the connection between the transformer 300 and the filter 70. FIG. 25 shows the in-band response of the filter and transformer assembly before full wave optimization. FIG. 26 is a top view of the filter and transformer assembly with dimensions in mm.

Figure 27:
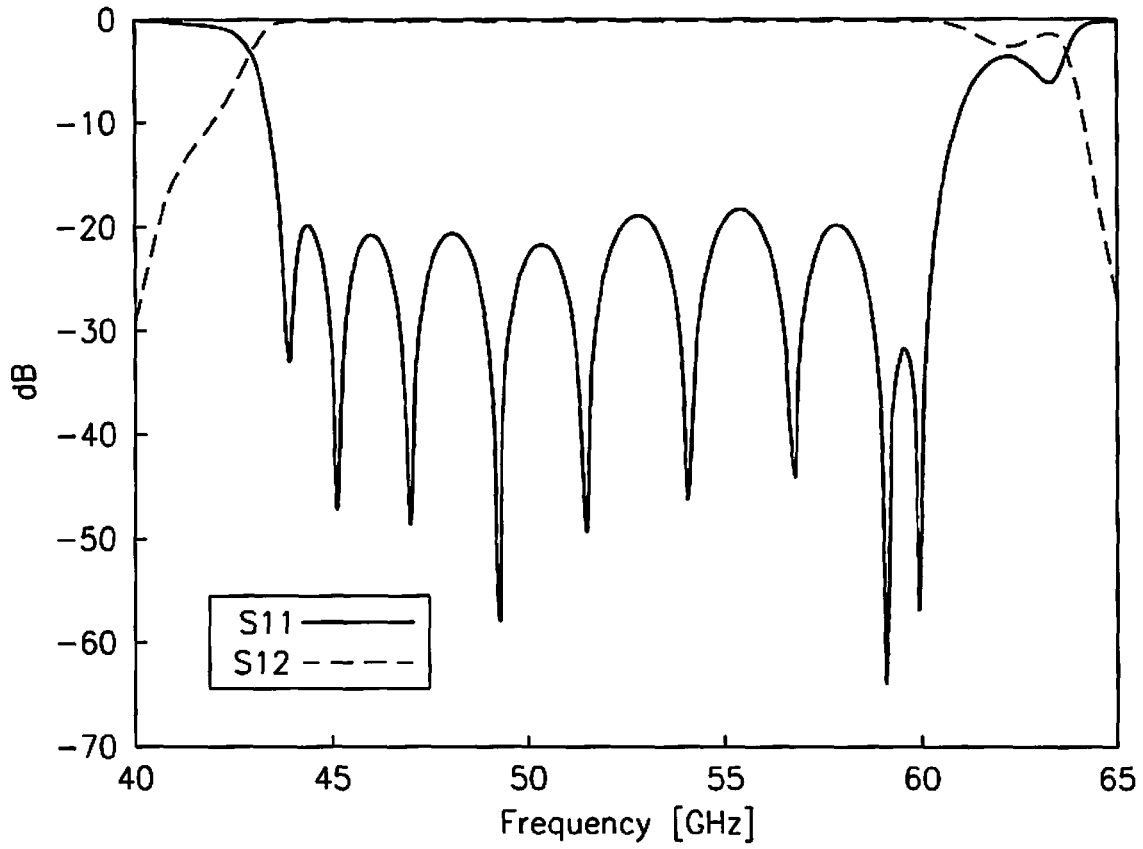
FIG. 27 shows the in-band response for the filter and transformer with the quadruple-ridge section of FIG. 18 and after full wave optimization.

FIG. 25 shows that the in-band return loss can be better than 10 dB after combining the filter 70 with the transformer 300. However, the return loss can be significantly improved by using the filter 70 with the quadruple-ridge section 210 (FIG. 18) having ridges 212. The ridges 212 may have a smaller ridge length than the ridges 14 of the quadruple-ridge section 100 shown in FIG. 6. FIG. 27 shows the in-band response for the filter and transformer with the quadruple-ridge section 210 after some final full wave optimization.

The present invention may preserve the dual polarization state of the electromagnetic field, guarantee wide bandwidth and at the same time exhibit a very wide stop-band frequency range. The invention may represent the state of the art in terms of a polarization preserving waveguide filter that offers an extremely wide stop-band frequency range. The inventive filter may exhibit the properties of a ridge waveguide filter, but can preserve the two polarization states of the electromagnetic field. The invention may be used in systems where coherent signal processing is an issue and, therefore, preserving the field polarization is a need.

Many variations of the invention are possible. For example, the invention may also be used for filtering only one polarization. In that case, the filter may be fed with a single polarization and an electric wall, such as a metal plate, may be used to longitudinally bisect the filter along the section shown in FIG. 14B. In other variations, some or all of the inventive filter may be filled with a dielectric material. Furthermore, four fold symmetry may be important for the various cross sections. Cross sections having symmetries greater than four fold are also within the scope of the invention. For example, an octagonal cross section may be used.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A waveguide filter, the waveguide filter comprising:

an input waveguide section, the input waveguide section supporting two polarization modes that are degenerate in frequency;

an output waveguide section;

a plurality of resonator sections disposed between the input and output waveguide sections;

a plurality of coupling sections disposed on either side of each of the resonator sections, wherein the input waveguide section, the resonator sections, and the output waveguide section comprise at least four-fold symmetric quadruple ridge cross-sections, the cross-sections being four-fold symmetrical along the axis of propagation, and the coupling sections comprise at least four-fold symmetric cross-sections such that polarization of each input mode is preserved.

2. The waveguide filter of claim 1, wherein interior perimeters of the input waveguide section, the resonator sections, the output waveguide section, and the coupling sections are generally square.

3. The waveguide filter of claim 1, wherein interior perimeters of the input waveguide section, the resonator sections, the output waveguide section, and the coupling sections are generally circular.

4. The waveguide filter of claim 1, wherein at least one of an interior perimeter of the input waveguide section, the resonator sections, the output waveguide section, and the coupling sections is generally square, and at least one of the interior perimeters is generally circular.

5. The waveguide filter of claim 1, wherein lengths of the coupling sections decrease from a midpoint of the waveguide filter towards ends of the waveguide filter.

6. The waveguide filter of claim 1, wherein lengths of the resonator sections increase from a midpoint of the waveguide filter towards ends of the waveguide filter.

7. The waveguide filter of claim 1, wherein a number of coupling sections is one greater than a number of resonator sections.

8. The waveguide filter of claim 1, wherein the waveguide filter includes an input waveguide section of approximately 2.0 millimeters, an output waveguide section of approximately 2.0 millimeters, a first coupling section of approximately 0.27 millimeters, a resonator section of approximately 1.27 millimeters, and a second coupling section of approximately 0.63 millimeters.

9. The waveguide filter of claim 1, wherein the waveguide filter includes an input waveguide section of approximately 1.0 millimeters, an output waveguide section of approximately 1.0 millimeters, a first resonator of approximately 1.39 millimeters, a second resonator of approximately 1.08 millimeters, a third resonator of approximately 0.94 millimeters, a first coupling section of approximately 0.08 millimeters, a second coupling section of approximately 0.027 millimeters, a third coupling section of approximately 0.47 millimeters, and a fourth coupling section of approximately 0.47 millimeters.

10. The waveguide filter of claim 1, wherein the waveguide filter includes an input waveguide section of approximately 1.5 millimeters, an output waveguide section of approximately 1.5 millimeters, a first resonator of approximately 1.32 millimeters, a second resonator of approximately 1.06 millimeters, a third resonator of approximately 0.96 millimeters, a fourth resonator of approximately 0.92 millimeters, a first coupling section of approximately 0.1 millimeters, a second coupling section of approximately 0.28 millimeters, a third coupling section of approximately 0.041 millimeters, and a fourth coupling section of approximately 0.046 millimeters.

11. The waveguide filter of claim 1, wherein the quadruple ridge cross-sections include an interior perimeter of approximately 0.75 millimeters, a ridge of approximately 0.2 millimeters, a cross-section of approximately 2.7 ×2.7 millimeters, a ridge height of approximately 1.7 millimeters, and a interior perimeter height of approximately 0.05 millimeters.

12. The waveguide filter of claim 1, the waveguide filter further comprising:

a housing, the housing including a number of sides, where the number of sides equals $2 \cdot 2n$, where n is an integer greater than or equal to 1.

13. A waveguide filter, the waveguide filter comprising:

an input waveguide section, the input waveguide section supporting two polarization modes that are degenerate in frequency;

an output waveguide section;

a first at least four fold symmetric quadruple-ridge section adjacent the input waveguide section;

a plurality of resonator sections disposed between the first quadruple-ridge section and the output waveguide section, a first resonator section being disposed adjacent the first quadruple-ridge section;

a plurality of coupling sections alternately disposed between the resonator sections, wherein the input waveguide section, the resonator sections, and the output waveguide section have second, at least four-fold symmetric quadruple ridge cross-sections, the cross-sections being four-fold symmetrical along the axis of propagation, the coupling sections have at least four-fold symmetric cross-sections, and the first quadruple-ridge section adjacent the input waveguide section includes ridges having lengths that are less than lengths of ridges of the second quadruple ridge cross-sections, such that polarization of each input mode is preserved.

14. The waveguide filter of claim 13, wherein interior perimeters of the input waveguide section, the output waveguide section, the first at least four fold symmetric quadruple-ridge section, the plurality of resonator sections, and the plurality of coupling sections are generally square.

15. The waveguide filter of claim 13, wherein interior perimeters of the input waveguide section, the output waveguide section, the first at least four fold symmetric quadruple-ridge section, the plurality of resonator sections, and the plurality of coupling sections are generally circular.

16. The waveguide filter of claim 13, wherein at least one of an interior perimeter of the input waveguide section, the output waveguide section, the first at least four fold symmetric quadruple-ridge section, the plurality of resonator sections, and the plurality of coupling sections is generally circular, and at least one of the interior perimeters is generally square.

17. The waveguide filter of claim 13, wherein lengths of the coupling sections decrease from a midpoint of the waveguide filter towards ends of the waveguide filter.

18. The waveguide filter of claim 13, wherein lengths of the resonator sections increase from a midpoint of the waveguide filter towards ends of the waveguide filter.

19. The waveguide filter of claim 13, wherein a number of coupling sections is equal to a number of resonator sections.

20. The waveguide filter of claim 13, the waveguide filter further comprising:

a housing, the housing including a number of sides, where the number of sides equals 2·2n, where n is an integer greater than or equal to 1.

21. A transformer, the transformer comprising:

a housing with an at least four fold symmetric interior perimeter, the housing including a number of sides, where the number of sides equals 2·2n, where n is an integer greater than or equal to 1; and four ridges disposed at ninety degree intervals inside the interior perimeter, each ridge comprising a series of steps.

22. The transformer of claim 21, wherein ridge length increases along a longitudinal axis of the housing.

23. The transformer of claim 21, wherein the interior perimeter is generally square.

24. The transformer of claim 21, wherein the interior perimeter is generally circular.

25. An apparatus, the apparatus comprising:

a waveguide filter, the waveguide filter comprising:

an input waveguide section, the input waveguide section supporting two polarization modes that are degenerate in frequency;

an output waveguide section;

a first at least four fold symmetric quadruple-ridge section adjacent the input waveguide section;

a plurality of resonator sections disposed between the first quadruple-ridge section and the output waveguide section, a first resonator section being disposed adjacent the first quadruple-ridge section;

a plurality of coupling sections alternately disposed between the resonator sections, wherein the input waveguide section, the resonator sections, and the output waveguide section have second, at least four-fold symmetric quadruple ridge cross-sections, the cross-sections being four-fold symmetrical along the axis of propagation, the coupling sections have at least four-fold symmetric cross-sections, and the first quadruple-ridge section adjacent the input waveguide section includes ridges having lengths that are less than lengths of ridges of the second quadruple ridge cross-sections; and a transformer comprising an at least four fold symmetric quadruple ridge cross section having four ridges, each ridge comprising a series of steps wherein ridge length increases along a longitudinal axis in the house, wherein the second end of the transformer is fixed to the waveguide filter such that the four ridges of the transformer abut the quadruple ridge cross section of one of the input and output waveguide sections, such that polarization of each input mode is preserved.

26. The apparatus of claim 25, further comprising:

a second transformer identical to the transformer and having its second end fixed to the waveguide filter such that the four ridges of the second transformer abut the quadruple ridge cross section of the other of the input and output waveguide sections.

27. An apparatus, the apparatus comprising:

a waveguide filter, the waveguide filter comprising:

an input waveguide section, the input waveguide section supporting two polarization modes that are degenerate in frequency;

an output waveguide section;

a plurality of resonator sections disposed between the input and output waveguide sections;

a plurality of coupling sections disposed on either side of each of the resonator sections, wherein the input waveguide section, the resonator sections, and the output waveguide section comprise at least four-fold symmetric quadruple ridge cross-sections, the cross-sections being four-fold symmetrical along the axis of propagation, and the coupling sections comprise at least four-fold symmetric cross-sections; and a transformer comprising an at least four fold symmetric quadruple ridge cross section having four ridges, each ridge comprising a series of steps wherein ridge length increases along a longitudinal axis in the house, wherein the second end of the transformer is fixed to the waveguide filter such that the four ridges of the transformer abut the quadruple ridge cross section of one of the input and output waveguide sections, such that polarization of each input mode is preserved.

28. The apparatus of claim 27, further comprising:

a second transformer identical to the transformer and having its second end fixed to the waveguide filter such that the four ridges of the transformer abut the quadruple ridge cross section of the other of the input and output waveguide sections.

29. A waveguide structure, the waveguide structure comprising:

a pair of quadruple ridge waveguide sections having at least four fold symmetry, the waveguide sections supporting two polarization modes that are degenerate in frequency, the four fold symmetry being along the axis of propagation; and a four fold symmetric evanescent section disposed between the pair of quadruple ridge resonator sections, the modes being evanescent along the axis of propagation.

* * * * *